US008111221B2

(12) United States Patent
Ono

(10) Patent No.: US 8,111,221 B2
(45) Date of Patent: Feb. 7, 2012

(54) DISPLAY PANEL DEVICE AND CONTROL METHOD THEREOF

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/889,572

(22) Filed: Sep. 24, 2010

(65) Prior Publication Data

US 2011/0057966 A1 Mar. 10, 2011

Related U.S. Application Data

(63) Continuation of application No. PCT/JP2009/004431, filed on Sep. 8, 2009.

(51) Int. Cl.
*G09G 3/30* (2006.01)

(52) U.S. Cl. ..... 345/76; 345/77; 345/82

(58) Field of Classification Search ..... 345/36, 345/39, 45–46, 76–77, 54, 87–88, 92, 204, 345/214, 690; 315/169.1, 169.3; 257/208
See application file for complete search history.

(56) References Cited

U.S. PATENT DOCUMENTS

| | | | | |
|---|---|---|---|---|
| 6,864,637 | B2 * | 3/2005 | Park et al. | 315/169.1 |
| 7,129,643 | B2 * | 10/2006 | Shin et al. | 315/169.3 |
| 7,205,965 | B2 | 4/2007 | Mikami et al. | |
| 7,274,345 | B2 | 9/2007 | Imamura et al. | |
| 7,319,447 | B2 * | 1/2008 | Hsueh | 345/82 |
| 7,932,880 | B2 * | 4/2011 | Takahara et al. | 345/76 |
| 8,018,404 | B2 * | 9/2011 | Ono | 345/76 |
| 2003/0111966 | A1 | 6/2003 | Mikami et al. | |
| 2003/0128173 | A1 * | 7/2003 | Ko | 345/82 |
| 2004/0257353 | A1 | 12/2004 | Imamura et al. | |
| 2005/0052377 | A1 * | 3/2005 | Hsueh | 345/82 |
| 2006/0007070 | A1 | 1/2006 | Shih | |
| 2006/0044235 | A1 | 3/2006 | Lee et al. | |
| 2006/0077194 | A1 | 4/2006 | Jeong | |
| 2007/0296652 | A1 | 12/2007 | Imamura et al. | |
| 2010/0201722 | A1 | 8/2010 | Masumoto et al. | |
| 2010/0214273 | A1 | 8/2010 | Shirouzu et al. | |
| 2010/0245331 | A1 | 9/2010 | Shirouzu et al. | |
| 2010/0259527 | A1 | 10/2010 | Odawara et al. | |
| 2010/0259531 | A1 * | 10/2010 | Ono | 345/212 |

FOREIGN PATENT DOCUMENTS

| | | |
|---|---|---|
| JP | 2003-186438 | 7/2003 |
| JP | 2005-004173 | 1/2005 |
| JP | 2005-346073 | 12/2005 |
| JP | 2006-072303 | 3/2006 |
| JP | 2006-113586 | 4/2006 |

* cited by examiner

*Primary Examiner* — Alexander S Beck
*Assistant Examiner* — Mansour M Said
(74) *Attorney, Agent, or Firm* — Greenblum & Bernstein, P.L.C.

(57) ABSTRACT

A display panel device includes a luminescence element and a capacitor. A driving transistor includes a gate that is connected to a first electrode of the capacitor. A first switch is connected to the first electrode of the capacitor for setting a reference voltage to the first electrode of the capacitor. A data line supplies a data voltage to a second electrode of the capacitor. A second switch is connected between the data line and the second electrode of the capacitor. A wiring is connected to a first electrode of the luminescence element and the second electrode of the capacitor for interconnecting a first power line and the first electrode of the luminescence element with the second electrode of the capacitor, the second switch, and the data line. A third switch is connected in series with the driver between the first electrode of the luminescence element and the first power line.

16 Claims, 17 Drawing Sheets

DISPLAY PANEL DEVICE AND CONTROL METHOD THEREOF

CROSS REFERENCE TO RELATED APPLICATION

This is a continuation application of PCT Application No. PCT/JP2009/004431 filed Sep. 8, 2009, designating the United States of America, the disclosure of which, including the specification, drawings, and claims, is incorporated herein by reference in its entirety.

BACKGROUND OF THE INVENTION

1. Field of the Invention

The present invention relates to display panel devices and control methods thereof, and particularly to a display panel device using current-driven luminescence elements, and a control method thereof.

2. Description of the Related Art

Image display devices using organic electroluminescence (EL) elements have been known as image display devices using current-driven luminescence elements. Organic EL display devices using luminescence-producing organic EL elements do no require backlight necessary for liquid crystal display devices, and are suitable for flattening of display apparatuses. Furthermore, having no limitation on a view angle, the organic EL display devices are expected for practical use as next-generation display devices. The organic EL elements used in the organic EL display devices allow luminance of each of the organic EL elements to be controlled according to a current value of a current flowing thereinto, which differs from liquid crystal cells each of which is controlled according to a voltage to be applied thereto.

In a usual organic EL display device, organic EL elements serving as pixels are arranged in a matrix. An organic EL display is called a passive-matrix organic EL display, in which organic EL elements are provided at intersections of row electrodes (scanning lines) and column electrodes (data lines) and voltages corresponding to data signals are applied to between selected row electrodes and the column electrodes to drive the organic EL elements.

On the other hand, switching thin-film transistors (TFTs) are provided at intersections of scanning lines and data lines, connected to gates of driving elements, and turned on through selected scanning lines, and then data signals are inputted to the driving elements via signal lines. An organic EL element driven by a driving element is called an active-matrix organic EL display device.

Unlike the passive-matrix organic EL display device in which the organic EL elements connected to each of the row electrodes (scanning lines) produce luminescence only in a period during which each row electrode is being selected, because the active-matrix organic EL display device allows the organic EL elements to produce luminescence until next scanning (selection), the active-matrix organic EL display device does not cause a decrease in luminance of a display even when the number of scanning lines increases. Thus, the active-matrix organic EL display device can be driven at a low voltage, thereby achieving less power consumption.

Patent Reference 1 (Japanese Unexamined Patent Application Publication no. 2005-4173) discloses a circuit configuration of a pixel unit included in an active-matrix organic EL display device.

FIG. 17 is a circuit configuration diagram of a pixel unit included in the conventional organic EL display device described in Patent Reference 1. A pixel unit 500 in the figure is configured by a simple circuit element which includes: an organic EL element 505 having a cathode connected to a negative power line (voltage value is VEE); an n-type thin-film transistor (n-type TFT) 504 having a drain connected to a positive power line (voltage value is VDD) and a source connected to an anode of the organic EL element 505; a capacitor element 503 that is connected between a gate and the source of the n-type TFT 504 and holds a gate voltage of the n-type TFT 504; a third switching element 509 that causes both terminals of the organic EL element 505 to have a substantially same potential; a first switching element 501 that selectively applies a video signal via a signal line 506 to the gate of the n-type TFT 504; and a second switching element 502 that initializes a gate potential of the n-type TFT 504 to a predetermined potential. The following describes luminescence operation of the pixel unit 500.

First, the second switching element 502 is turned on with a scanning signal provided from a second scanning line 508, and the n-type TFT 504 is initialized by applying a predetermined voltage VREF supplied from a reference power line so that a current does not flow between the source and the gate of the n-type TFT 504 (S101).

Next, the second switching element 502 is turned off with another scanning signal provided from the second scanning line 508 (S102).

Next, the first switching element 501 is turned on with a scanning signal provided from a first scanning line 507, and a signal voltage supplied from the signal line 506 is applied to the gate of the n-type TFT 504 (S103). Here, a gate of the third switching element 509 is connected to the first scanning line 507, and becomes conductive concurrently with conduction of the first switching element 501. Accordingly, a charge corresponding to the signal voltage is accumulated in the capacitor element 503 without being influenced by a voltage across the terminals of the organic EL element 505. In addition, because a current does not flow into the organic EL element 505 while the third switching element 509 is being conductive, the organic EL element 505 does not produce luminescence.

Finally, the third switching element 509 is turned off with another scanning signal provided from the first scanning line 507, and a signal current corresponding to the charge accumulated in the capacitor element 503 is supplied from the n-type TFT 504 to the organic EL element 505 (S104). Here the organic EL element 505 produces luminescence.

With a series of above-mentioned operation, in one frame period, the organic EL element 505 produces luminescence at luminance corresponding to the signal voltage supplied from the signal line.

SUMMARY OF THE INVENTION

However, in the conventional organic EL display device disclosed in Patent Reference 1, when the signal voltage is recorded at the gate of the n-type TFT 504 (S103), the n-type TFT 504 is turned on, and then a current flows from the third switching element 509 into the negative power line. A flow of the current in a resistance component of the third switching element 509 and the negative power line causes a source potential of the n-type TFT 504 to vary. In other words, a voltage to be held by the capacitor element 503 varies.

As stated above, when a pixel circuit that performs a source grounding operation using an n-type TFT represented by amorphous Si is configured, it is difficult to record accurate potentials at both terminals of a capacitor element that holds a gate-to-source voltage of a driving n-type TFT. Thus, luminescence elements do not accurately produce luminescence, because accurate signal currents corresponding to signal voltages do not flow thereinto, and in consequence a highly accurate image reflecting video signals is not displayed.

In view of the above problems, the present invention has an object to provide an image display device that is configured by a simple pixel circuit including luminescence pixels which make it possible to record accurate potentials corresponding to signal voltages at both end electrodes of a capacitance that holds a gate-to-source voltage of a driving TFT.

In order to achieve the above object, a display panel device according to an aspect of the present invention includes: a luminescence element; a capacitor which holds a voltage; a driving element which has a gate electrode connected to a first electrode of the capacitor, and causes the luminescence element to produce luminescence by passing, into the luminescence element, a drain current corresponding to the voltage held by the capacitor; a first power line for determining a potential of a drain electrode of the driving element; a second power line electrically connected to a second electrode of the luminescence element; a first switching element for setting a reference voltage to the first electrode of the capacitor; a data line for supplying a data voltage to a second electrode of the capacitor; a second switching element which has one of terminals electrically connected to the data line and the other of the terminals electrically connected to the second electrode of the capacitor, and switches between conduction and non-conduction between the data line and the second electrode of the capacitor; a wiring for electrically connecting a first electrode of the luminescence element and the second electrode of the capacitor, and serving as a path to connect the first power line, the first electrode of the luminescence element, the second electrode of the capacitor, the second switching element, and the data line with each other; and a third switching element which is provided between the first electrode of the luminescence element and the first power line and connected in series with the driving element, and which determines on and off of the drain current of the driving element.

The display panel device and a control method thereof in the present invention make it possible to prevent a current from flowing into a power line and a data line at the time of writing, by controlling a current pathway of a current flowing into a driving TFT. Thus, an accurate potential can be recorded at both end terminals of a capacitor element using a switching TFT and a resistance component of the power line during a writing period, and a highly accurate image reflecting video signals can be displayed.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

Figure 1:
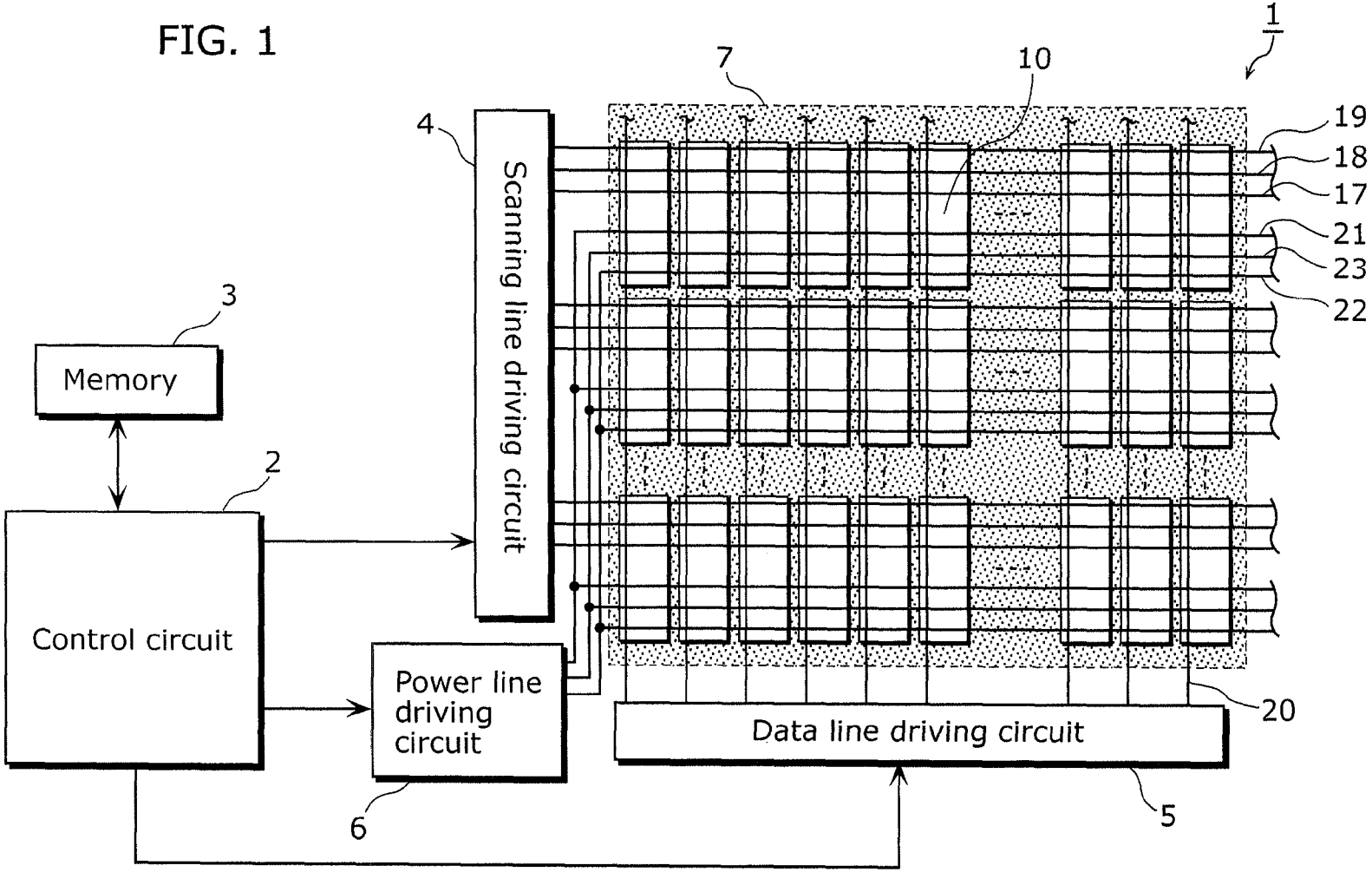
FIG. 1 is a block diagram showing an electrical configuration of a display device of the present invention.

A display panel device according to an implementation of the present invention includes: a luminescence element; a capacitor which holds a voltage; a driving element which has a gate electrode connected to a first electrode of the capacitor, and causes the luminescence element to produce luminescence by passing, into the luminescence element, a drain current corresponding to the voltage held by the capacitor; a first power line for determining a potential of a drain electrode of the driving element; a second power line electrically connected to a second electrode of the luminescence element; a first switching element for setting a reference voltage to the first electrode of the capacitor; a data line for supplying a data voltage to a second electrode of the capacitor; a second switching element which has one of terminals electrically connected to the data line and the other of the terminals electrically connected to the second electrode of the capacitor, and switches between conduction and non-conduction between the data line and the second electrode of the capacitor; a wiring for electrically connecting a first electrode of the luminescence element and the second electrode of the capacitor, and serving as a path to connect the first power line, the first electrode of the luminescence element, the second electrode of the capacitor, the second switching element, and the data line with each other; and a third switching element which is provided between the first electrode of the luminescence element and the first power line and connected in series with the driving element, and which determines on and off of the drain current of the driving element.

According to the circuit configuration of the implementation, after interrupting the current flowing between the first power line and the data line via a source electrode of the driving element and the second switching element, the third switching element makes it possible to cause the capacitor to hold a voltage having a desired difference between potential. This prevents the difference in potential between the both terminals of the second switching element from varying depending on the current flowing between the first power line and the data line via the source electrode of the driving element and the second switching element. Accordingly, the difference in potential between the both terminals of the second switching element is stabilized, and a voltage corresponding to the voltage have the desired difference in potential can be accurately held by the capacitor from the data line via the second switching element. As a result, the difference in potential between the gate and the source of the driving element is stabilized, and a drain current corresponding to the voltage having the desired difference in potential can be accurately passed to the luminescence element.

The display panel device according to the implementation of the present invention may further include a control unit configured to control the first, second, and third switching elements, wherein the control unit is configured to (i) turn off the third switching element and, while a flow of the drain current between the first power line and the data line via the wiring and the second switching element is interrupted, (ii) turn on the first and second switching elements to set the reference voltage to the first electrode of the capacitor and to set the data voltage to the second electrode of the capacitor, so as to cause the capacitor to hold a voltage having a desired difference in potential, and (iii) turn on the third switching element while the first and second switching elements are in an off-state, and cause the drain current corresponding to the voltage having the desired difference in potential to flow into the luminescence element.

According to the implementation, the control unit controls the operations of the first to third switching elements. In other words, after the current flowing between the first power line and the data line via the source electrode of the driving element and the second switching element is interrupted, the voltage having the desired difference in potential is accumulated in the capacitor. This prevents the difference in potential between the both terminals of the second switching element from varying depending on the current flowing between the first power line and the data line via the source electrode of the driving element and the second switching element. Accordingly, the difference in potential between the both terminals of the second switching element is stabilized, and a voltage corresponding to the voltage have the desired difference in potential can be accurately held by the capacitor from the data line via the second switching element. As a result, the difference in potential between the gate and the source of the driving element is stabilized, and a drain current corresponding to the voltage having the desired difference in potential can be accurately passed to the luminescence element.

In the display panel device according to the implementation of the present invention, the control unit may turn off the third switching element to interrupt (i) a flow of a current between the first power line and the data line via said wiring and the second switching element and (ii) a flow of a current between the first and second power lines.

According to the implementation, after the drain current flowing between the first power line and the second power line is interrupted, the voltage having the desired difference in potential is held by the capacitor. Accordingly, a current does not flow into an element (here, a luminescence element or switching transistor) having the second electrode connected to the capacitor before a voltage held by the capacitor becomes the voltage having the desired difference in potential. Thus, it is possible to prevent a current corresponding to the voltage held by the capacitor from flowing into the luminescence element or the switching transistor before the voltage held by the capacitor becomes the voltage having the desired difference in potential. To put it differently, it is possible to pass to the luminescence element the accurate drain current corresponding to the voltage having the desired difference in potential because the capacitor can hold an accurate voltage corresponding to the voltage having the desired difference in potential.

Further, the third switching element which passes the drain current is connected in series with the driving element between the luminescence element and the power line, and is provided between the first power line and the second power line. This suppresses the occurrence of inrush current, and allows an amount of current supplied to the luminescence element to be accurately controlled. As a result, the contrast of an image can be enhanced.

Stated differently, a control of turning the third switching element off allows the difference in potential between the gate and the source of the driving element by stabilizing the difference in potential at the both terminals of the second switching element, and suppresses the inrush current. Consequently, it is possible to accurately hold the voltage corresponding to the voltage having the desired difference in potential in the capacitor, and to accurately pass to the luminescence element the drain current corresponding to the voltage having the desired difference in potential.

In the display panel device according to the implementation of the present invention, for instance, the third switching element may be connected in series between the first power line and a drain of the driving element, and the wiring may connect the second electrode of the capacitor and the first electrode of the luminescence element which is connected to a source of the driving element.

In the display panel device according to the implementation of the present invention, for example, the third switching element may be connected in series between the first electrode of the luminescence element and a source of the driving element, and the wiring may connect the second electrode of the capacitor and the first electrode of the luminescence element which is connected to the third switching element.

In the display panel device according to the implementation of the present invention, the first electrode of the luminescence element may be an anode electrode, and the second electrode of the luminescence element may be a cathode electrode, and a voltage of the first power line may be higher than a voltage of the second power line, and a current may flow from the first power line to the second power line.

According to the implementation, the driving element may be configured by an n-type transistor.

In the display panel device according to the implementation of the present invention, the control unit may (i) turn off the third switching element to interrupt supply of a current from the first power line to the luminescence element, (ii) turn on the first and second switching elements to set the reference voltage to the first electrode of the capacitor and to set the data voltage to the second electrode of the capacitor, so as to cause the capacitor to hold a voltage having a desired difference in potential, and (iii) turn off the first switching element and turn on the second and third switching elements to pass, into the data line, the drain current corresponding to the voltage having the desired difference in potential via the wiring and the second switching element.

According to the implementation, when an amount of the current supplied via the first power line to the luminescence element is read and measured via the data line, it is possible to accurately measure the amount of the current supplied via the first power line to the luminescence element, because a condition for current to flow is same to a route from the first power line to the luminescence element and a route from the first power line to the data line.

Moreover, when the amount of the current supplied via the first power line to the luminescence element is read and measured via the data line, the current supplied from the power line is not measured before the voltage held by the capacitor becomes the voltage having the desired difference in potential. Thus, the current corresponding to the voltage held by the capacitor is supplied via the power line before the voltage held by the capacitor becomes the voltage having the desired difference in potential, thereby preventing measurement of the current. In other words, it is possible to measure an accurate amount of the current corresponding to the voltage having the desired difference in potential, because it is possible to hold in the capacitor an accurate voltage corresponding to the voltage having the desired difference in potential.

The display panel device according to the implementation of the present invention may include a setting unit configured to set, to the second power line, one of a first voltage and a second voltage, the first voltage being higher than a voltage obtained by subtracting a luminescence start voltage of the luminescence element from a preset voltage of a power supply unit connected to the first power line, and the second voltage being lower than the first voltage, wherein the data voltage is a voltage lower than the first voltage, and the control unit is configured to set the second voltage to the second power line, and turn off the second switching element to pass the drain current from the first power line into the luminescence element, when the luminescence element is caused to produce luminescence, and set the first voltage to the second power line, and turn on the second switching element to pass the drain current from the first power line into the data line, when the drain current is measured.

According to the implementation, when the drain current flowing from the first power line is measured via the data line, a difference in potential is set small such that the voltage of the second electrode of the luminescence element is a voltage larger than a voltage obtained by subtracting the luminescence start voltage of the luminescence element from the preset voltage of the power supply unit connected to the first power line. Consequently, when the third switching element is turned on, the current does not flow into the luminescence element, and the current flows from the first power line to the data line due to the difference in potential between the preset voltage and the data voltage.

In the display panel device according to the implementation of the present invention, the first electrode of the luminescence element may be a cathode electrode, and the second electrode of the luminescence element may be an anode electrode, and a voltage of the second power line may be higher than a voltage of the first power line, and a current may flow from the second power line to the first power line.

According to the implementation, the driving element may be configured by a p-type transistor.

In the display panel device according to the implementation of the present invention, the control unit may (i) turn off the third switching element to interrupt supply of a current from the first power line to the luminescence element, (ii) turn on the first and second switching elements to set the reference voltage to the first electrode of the capacitor and to set the data voltage to the second electrode of the capacitor, so as to cause the capacitor to hold a voltage having a desired difference in potential, and (iii) turn off the first switching element and turn on the second and third switching elements to pass, from the data line, the drain current corresponding to the voltage having the desired difference in potential via the wiring and the second switching element.

According to the implementation, when an amount of the current supplied via the second power line to the luminescence element is read and measured via the data line, it is possible to accurately measure the amount of the current supplied via the first power line to the luminescence element, because a condition for current to flow is same to a route from the first power line to the luminescence element and a route from the first power line to the data line.

Moreover, when the amount of the current supplied via the first power line to the luminescence element is read and measured via the data line, the current supplied from the second power line is not measured before the voltage held by the capacitor becomes the voltage having the desired difference in potential. Thus, the current corresponding to the voltage held by the capacitor is supplied via the second power line before the voltage held by the capacitor becomes the voltage having the desired difference in potential, thereby preventing measurement of the current. In other words, it is possible to measure an accurate amount of the current corresponding to the voltage having the desired difference in potential, because it is possible to hold in the capacitor an accurate voltage corresponding to the voltage having the desired difference in potential.

The display panel device according to the implementation of the present invention may include a setting unit configured to set, to the second power line, one of a third voltage and a fourth voltage, the third voltage being lower than a voltage obtained by adding a luminescence start voltage of the luminescence element to a preset voltage of a power supply unit connected to the first power line, the fourth voltage being higher than the third voltage, wherein the data voltage is a voltage higher than the first voltage, and the control unit is configured to set the fourth voltage to the second power line, and turn off the second switching element to pass a current from the luminescence element into the first power line, when the luminescence element is caused to produce luminescence, and set the third voltage to the second power line, and turn on the second switching element to pass the drain current from the data line into the first power line, when the drain current is measured.

According to the implementation, the drain current flowing into the first power line is measured via the data line, a difference in potential is set small such that the voltage of the second electrode of the luminescence element is a voltage larger than a voltage obtained by adding the luminescence start voltage of the luminescence element to the preset voltage of the power supply unit connected to the first power line. Consequently, when the third switching element is turned on, the current does not flow into the luminescence element, and the current flows from the data line to the first power line due to the difference in potential between the preset voltage and the data voltage.

A display device according to an implementation of the present invention may include: the display panel device; and a power source which supplies power to the first and second power lines, wherein the luminescence element includes the first electrode, the second electrode, and a luminescence layer sandwiched between the first electrode and the second electrode, and at least luminescence elements including the luminescence element are arranged in a matrix.

A display device according to an implementation of the present invention may include the display panel device; and a power source which supplies power to the first and second power lines, wherein the luminescence element includes the first electrode, the second electrode, and a luminescence layer sandwiched by the first electrode and the second electrode, a pixel circuit of a unit pixel includes at least the luminescence element and the third switching element, and pixel circuits including the pixel circuit are arranged in a matrix.

A display device according to an implementation of the present invention may include: the display panel device; and a power source which supplies power to the first and second power lines, wherein the luminescence element includes the first electrode, the second electrode, and a luminescence layer sandwiched between the first electrode and the second electrode, a pixel circuit of a unit pixel includes the luminescence element, the capacitor, the driving element, the first switching element, the second switching element, and the third switching element, and pixel circuits including the pixel circuit are arranged in a matrix.

In the display device according to the implementation of the present invention, the luminescence element may be an organic electroluminescence element.

A control method for a display device according to an implementation of the present invention, wherein the display device may include: a luminescence element; a capacitor which holds a voltage; a driving element which has a gate electrode connected to a first electrode of the capacitor, and causes the luminescence element to produce luminescence by passing, into the luminescence element, a drain current corresponding to the voltage held by the capacitor; a first power line for determining a potential of a drain electrode of the driving element; a second power line electrically connected to a second electrode of the luminescence element; a first switching element for setting a reference voltage to the first electrode of the capacitor; a data line for supplying a data voltage to a second electrode of the capacitor; a second switching element which has one of terminals electrically connected to the data line and the other of the terminals electrically connected to a second electrode of the capacitor, and switches between conduction and non-conduction between the data line and the second electrode of the capacitor; a wiring which electrically connects a first electrode of the luminescence element and the second electrode of the capacitor, and serves as a path to connect the first power line, the first electrode of the luminescence element, the second electrode of the capacitor, the second switching element, and the data line with each other; and a third switching element which is provided between the first electrode of the luminescence element and the first power line and connected in series with the driving element, and which determines on and off of the drain current of the driving element, and the control method may include: turning off the third switching element to interrupt a flow of the drain current between the first power line and the data line via the wiring and the second switching element; turning on the first and second switching elements to set the reference voltage to the first electrode of the capacitor and to set the data voltage to the second electrode of the capacitor, so as to cause the capacitor to hold a voltage having a desired potential, while the flow of the current is being interrupted; and turning off the first and second switching elements and turning on the third switching element to pass, into the luminescence element, the drain current corresponding to the voltage having the desired potential held by the capacitor, after the voltage having the desired potential is caused to be held.

The following describes preferred embodiments of the present invention with reference to the drawings. It is to be noted that hereinafter the same numeral references are assigned to the same or corresponding elements, and overlapping descriptions thereof are omitted.

Embodiment 1

The following describes in detail Embodiment 1 of the present invention with reference to the drawings.

FIG. 1 is a block diagram showing an electrical configuration of a display device of the present invention. A display device 1 in the figure includes a control circuit 2, a memory 3, a scanning line driving circuit 4, a data line driving circuit 5, a power line driving circuit 6, and a display unit 7.

Figure 2:
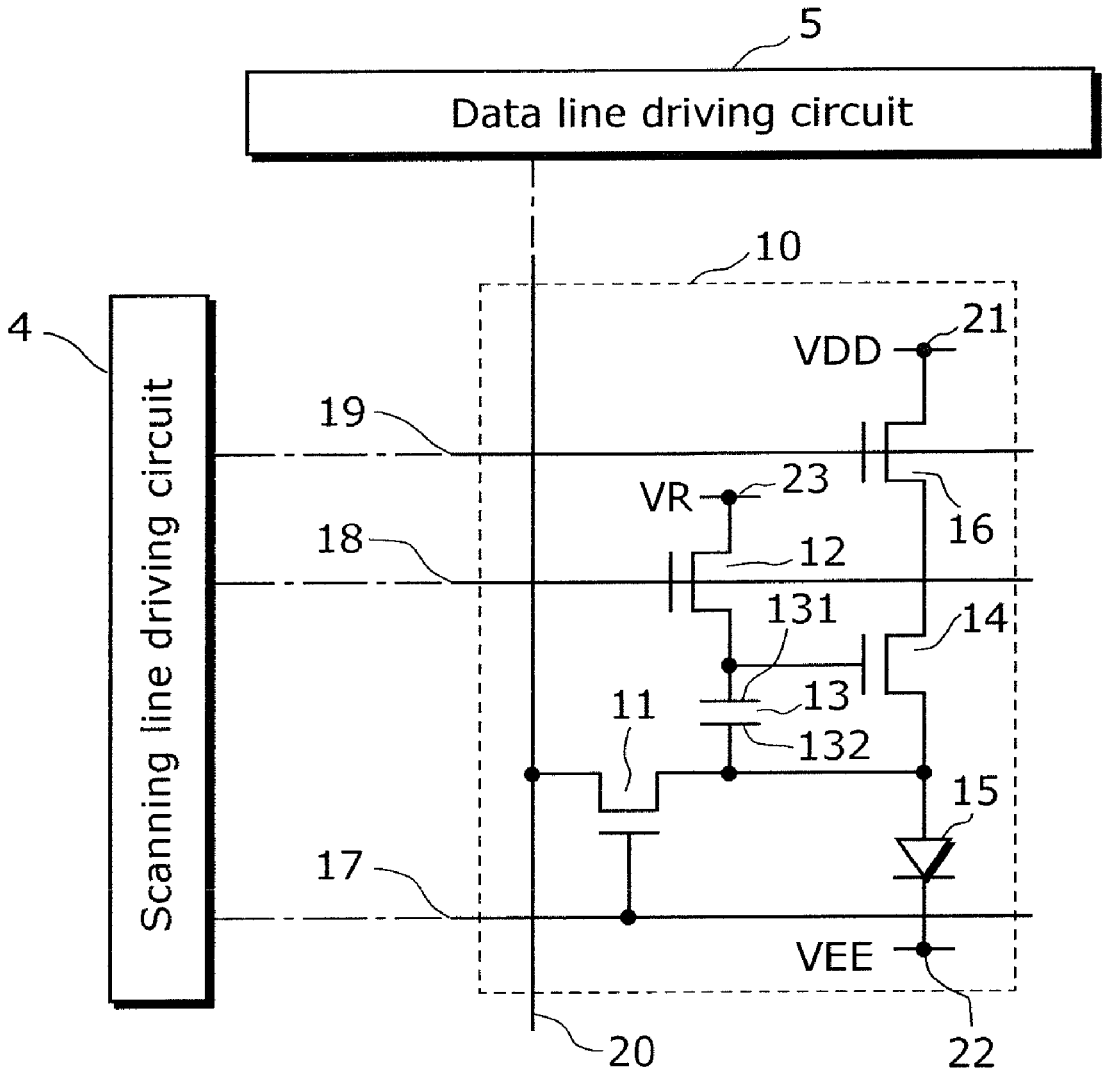
FIG. 2 is a diagram showing a circuit configuration of a luminescence pixel included in a display unit according to Embodiment 1 of the present invention, and connection between the luminescence pixel and peripheral circuitry thereof.

FIG. 2 is a diagram showing a circuit configuration of a luminescence pixel included in a display unit according to Embodiment 1 of the present invention, and connection between the luminescence pixel and peripheral circuitry thereof. A luminescence pixel 10 in the figure includes a selection transistor 11, switching transistors 12 and 16, a capacitor element 13, a driving transistor 14, an organic EL element 15, a first scanning line 17, a second scanning line 18, a third scanning line 19, a data line 20, a first power line 21, a second power line 22, and a reference power line 23. In addition, the peripheral circuitry includes the scanning line driving circuit 4 and the data line driving circuit 5.

The following describes connection relationships and functions of the constitutional elements described in FIGS. 1 and 2.

The control circuit 2 functions to control the scanning line driving circuit 4, the data line driving circuit 5, the power line driving circuit 6, and the memory 3. The memory 3 stores, for example, correction data of each of luminescence pixels, and the control circuit 2 reads the correction data written into the memory 3, corrects an externally inputted video signal based on the correction data, and outputs the corrected video signal to the data line driving circuit 5.

Furthermore, the control circuit 2 controls via the scanning line driving circuit 4 the selection transistor 11 and the switching transistors 12 and 16.

The scanning line driving circuit 4 is connected to the first scanning line 17, the second scanning line 18, and the third scanning line 19, and functions to perform control on conduction and non-conduction of the selection transistor 11 and the switching transistors 12 and 16 included in the luminescence pixel 10 by respectively outputting scanning signals to the first scanning line 17, the second scanning line 18, and the third scanning line 19, according to an instruction from the control circuit 2.

The data line driving circuit 5 is connected to the data line 20, and functions to output to the luminescence pixel 10 a data voltage based on a video signal.

The power line driving circuit 6 is connected to the first power line 21, the second power line 22, and the reference power line 23, and functions to respectively set a first power supply voltage VDD, a second power supply voltage VEE, and a reference voltage VR that are common to all the luminescence pixels, according to an instruction from the control circuit 2.

The display unit 7 includes luminescence pixels 10, and displays an image based on video signals inputted from the outside to the display device 1.

The selection transistor 11 is a second switching element having a gate connected to the first scanning line 17, one of a source and a drain connected to the data line 20, and the other one connected to an electrode 132 that is a second electrode of the capacitor element 13. The selection transistor 11 functions to determine timing at which the data voltage of the data line 20 is applied to the electrode 132 of the capacitor element 13.

The switching transistor 12 is a first switching element having a gate connected to the second scanning line 18, one of a source and a drain connected to the reference power line 23, and the other one connected to an electrode 131 that is a first electrode of the capacitor element 13. The switching transistor 12 functions to determine timing at which the reference voltage VR of the reference power line 23 is applied to the electrode 131 of the capacitor element 13. The selection transistor 11 and the switching transistor 12 are configured by, for instance, an n-type thin-film transistor (n-type TFT).

The capacitor element 13 is a capacitor having the electrode 131 connected to a gate of the driving transistor 14 and the electrode 132 connected to one of the source and the drain of the selection transistor 11 and a source of the driving transistor 14. When the selection transistor 11 and the switching transistor 12 are in an on-state, a reference voltage VR and a data voltage Vdata are applied to the electrodes 131 and 132, respectively, and (VR−Vdata), a difference in potential between the electrodes, is held by the capacitor element 13.

The driving transistor 14 is a driving element having a gate connected to the electrode 131 of the capacitor element 13, a drain connected to one of a source and a drain of the switching transistor 16, and a source connected to an anode that is a first electrode of the organic EL element 15. The driving transistor 14 transforms a voltage corresponding to a data voltage applied to between the gate and the source into a drain current corresponding to the data voltage. Then, the driving transistor 14 supplies the drain current as a signal current to the organic EL element 15. For example, when the selection transistor 11 and the switching transistor 12 are in an off-state and the switching transistor 16 is in an on-state, the driving transistor 14 functions to supply to the organic EL element 15 a voltage corresponding to a data voltage Vdata supplied from the data line 20, that is, a drain current corresponding to the voltage (VR−Vdata) held by the capacitor element 13. The driving transistor 14 is configured by, for instance, an n-type thin-film transistor (n-type TFT).

The organic EL element 15 is a luminescence element having an anode connected to the source of the driving transistor 14 and a cathode connected to the second power line 22. A flow of the drain current, the signal current, from the driving transistor 14 causes the organic EL element 15 to produce luminescence.

The switching transistor 16 is a third switching element having a gate connected to the third scanning line 19, one of a source and a drain connected to the drain of the driving transistor 14, and the other one connected to the first power line 21. The switching transistor 16 is provided between the anode of the organic EL element 15 and the first power line 21, connected in series with the driving transistor 14, and functions to determine turning on or off of the drain current of the driving transistor 14. The switching transistor 16 is configured by, for example, an n-type thin-film transistor (n-type TFT).

The first scanning line 17 is connected to the scanning line driving circuit 4, and to each of luminescence pixels belonging to a pixel row including the luminescence pixel 10. As a result, the first scanning line 17 functions to provide timing at which a data voltage is written into each of the luminescence pixels belonging to the pixel row including the luminescence pixel 10.

The second scanning line 18 is connected to the scanning line driving circuit 4, and to each of the luminescence pixels belonging to the pixel row including the luminescence pixel 10. Consequently, the second scanning line 18 functions to provide timing at which a reference voltage VR is applied to the electrode 131 of the capacitor element 13 included in each of the luminescence pixels belonging to the pixel row including the luminescence pixel 10.

The third scanning line 19 is connected to the scanning line driving circuit 4, and to each of the luminescence pixels belonging to the pixel row including the luminescence pixel 10. As a result, the third scanning line 19 functions to provide timing at which the drain of the driving transistor 14 and the first power supply voltage VDD are electrically connected, the driving transistor 14 being included in each of the luminescence pixels belonging to the pixel row including the luminescence pixel 10.

Moreover, the display device 1 includes as many first scanning lines 17, second scanning lines 18, and third scanning lines 19 as the number of pixel rows.

The data line 20 is connected to the data line driving circuit 5, and to each of luminescence pixels belonging to a pixel column including the luminescence pixel 10. The data line 20 functions to supply a data voltage that determines luminescence intensity.

Furthermore, the display device 1 includes as many data lines 20 as the number of pixel columns.

It is to be noted that, though not shown in FIGS. 1 and 2, each of the first power line 21, the second power line 22, and the reference power line 23 is commonly connected to all the luminescence pixels, and connected to the power line driving circuit 6. When a voltage obtained by adding a threshold voltage of the driving transistor 14 to a luminescence start voltage of the organic EL element 15 is greater than 0V, the reference power line 23 may have the same voltage as the second power line 22. Accordingly, types of output voltage of the power line driving circuit 6 are narrowed down, which further simplifies a circuit.

The above circuit configuration makes it possible to cause the capacitor element 13 to hold a voltage having a desired difference in potential after the switching transistor 16 interrupts a current flowing between the first power line 21 and the data line 20 via the source of the driving transistor 14 and the selection transistor 11. This prevents the difference in potential between the both terminals of the selection transistor 11 from varying depending on the current flowing between the first power line 21 and the data line 20 via the source of the driving transistor 14 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. Consequently, the difference in potential between the both electrodes of the capacitor element 13, that is, the difference in potential between the gate and the source of the driving transistor 14 is stabilized, and the drain current corresponding to the voltage having the desired difference in potential can be accurately passed to the organic EL element 15.

Next, the following describes a control method of the display device 1 according to the present embodiment with reference to FIGS. 3 to 8B.

FIGS. 3 to 5B describe the control method in a test mode, and FIGS. 6 to 8B describe the control method in a normal luminescence mode.

First, the control method in the test mode is described below. The test mode is a mode for writing a data voltage into the capacitor element 13 and then accurately measuring a drain current of the driving transistor 14 which is generated by a voltage corresponding to the written data voltage. A status of the driving transistor 14 is determined based on the measured drain current, which makes it possible to generate correction data.

Figure 3:
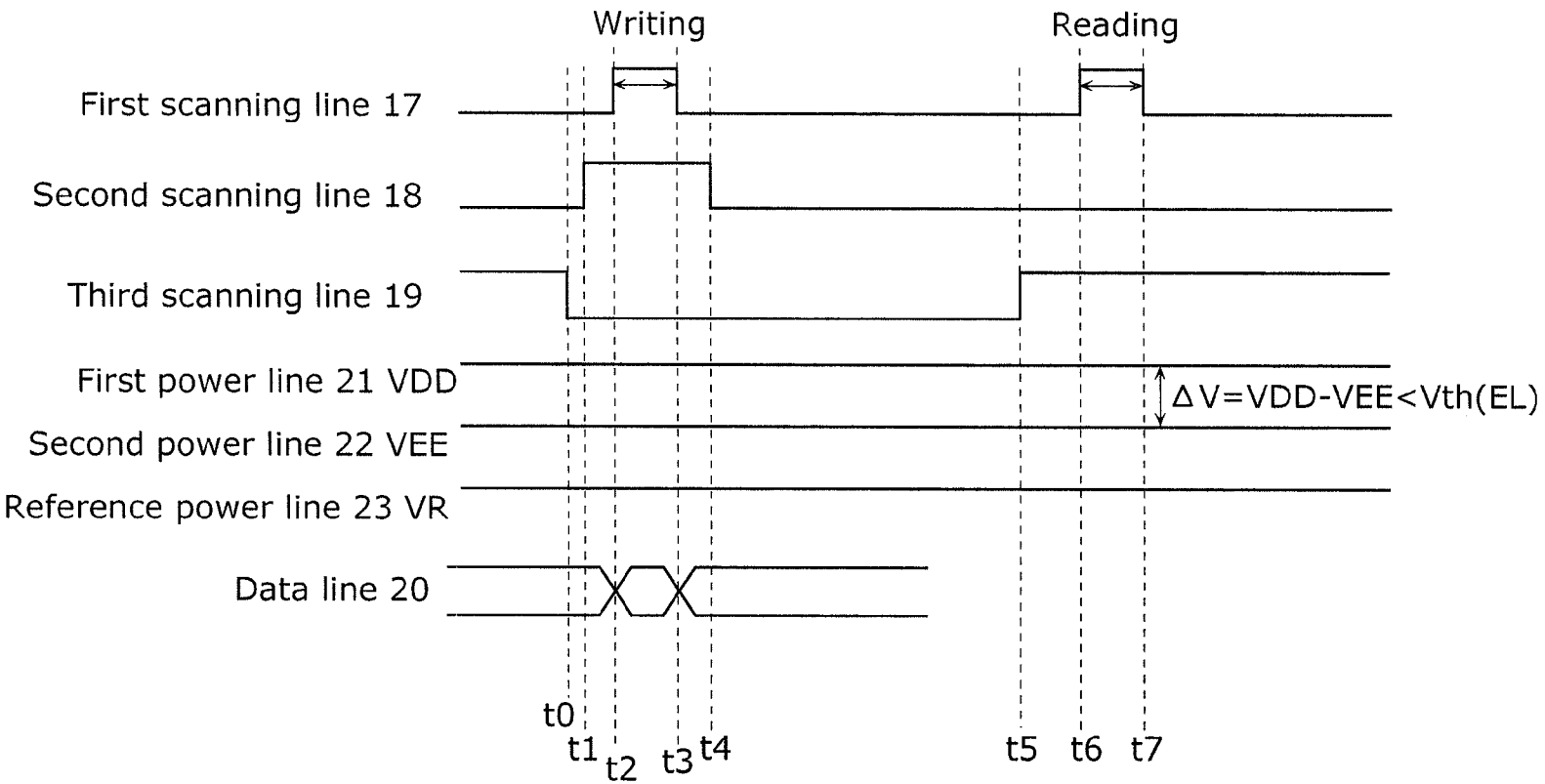
FIG. 3 is an operation timing diagram describing a control method in a test mode of the display device according to an embodiment of the present invention.
Figure 4:
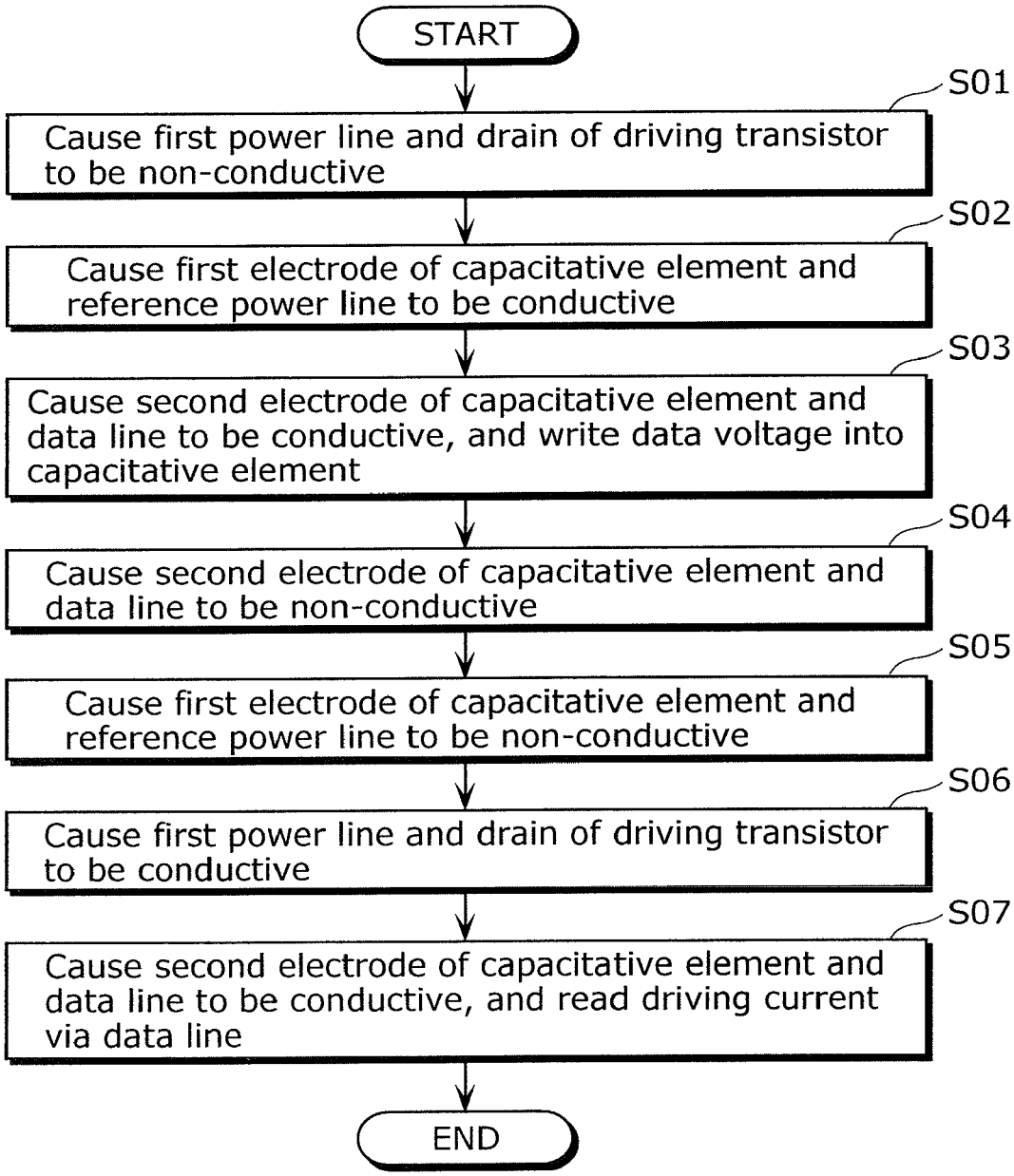
FIG. 4 is an operation flowchart describing the control method in the test mode of the display device according to Embodiment 1 of the present invention.

FIG. 3 is an operation flowchart describing the control method in the test mode of the display device according to Embodiment 1 of the present invention. In the figure, the horizontal axis indicates a time. Furthermore, in the vertical direction, wave form charts of voltages generated in the first scanning line 17, the second scanning line 18, the third scanning line 19, the first power line 21, the second power line 22, the reference power line 23, and the data line 20 are shown in this order. FIG. 4 is an operation flowchart describing the control method in the test mode of the display device according to Embodiment 1 of the present invention.

First, at a time t0, the scanning line driving circuit 4 changes a voltage level of the third scanning line 19 from high to low, and turns off the switching transistor 16. This causes the drain of the driving transistor 14 and the first power line 21 to be non-conductive (S01 in FIG. 4).

Next, at a time t1, the scanning line driving circuit 4 changes a voltage level of the second scanning line 18 from low to high, and turns on the switching transistor 12. This causes the electrode 131 of the capacitor element 13 and the reference power line 23 to be conductive, and a reference voltage VR is applied to the electrode 131 of the capacitor element 13 (S02 in FIG. 4).

Next, at a time t2, the scanning line driving circuit 4 changes a voltage level of the first scanning line 17 from low to high; and turns on the switching transistor 11. This causes the electrode 132 of the capacitor element 13 and the data line 20 to be conductive, and a data voltage Vdata is applied to the electrode 132 of the capacitor element 13 (S03 in FIG. 4).

Next, during a period between the time t2 and a time t3, the data voltage Vdata and the reference voltage VR are continuously being applied to the electrodes 131 and 132 of the capacitor element 13, respectively, because the voltage level of the first scanning line 17 is high. Likewise, the data voltage is being supplied to each of the luminescence pixels belonging to the pixel row including the luminescence pixel 10.

Figure 5B:
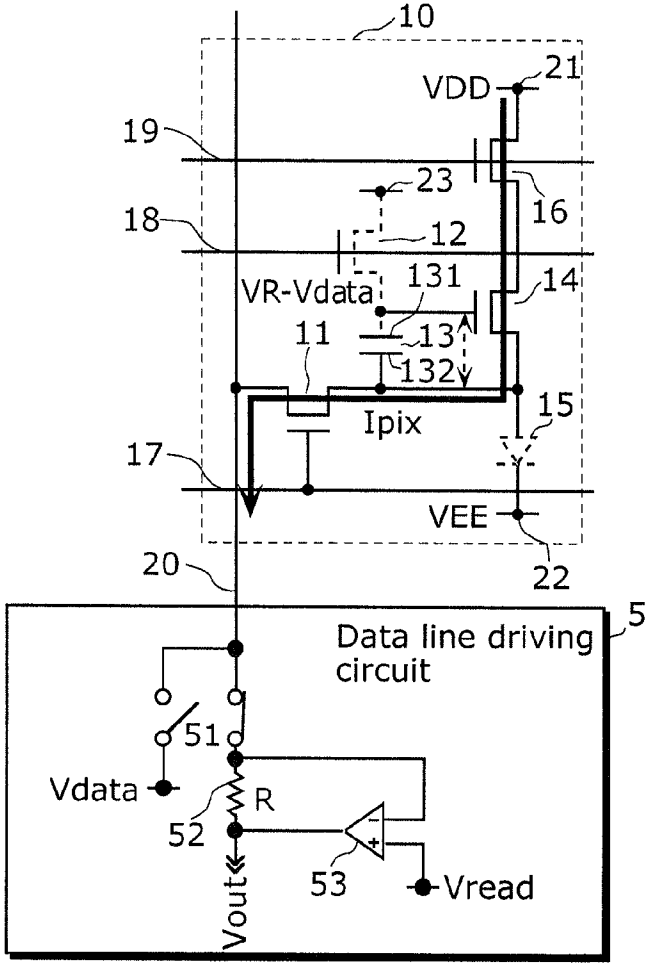
FIG. 5B is a circuit diagram showing a state of drain current reading in the test mode of the display device according to Embodiment 1 of the present invention.
Figure 5A:
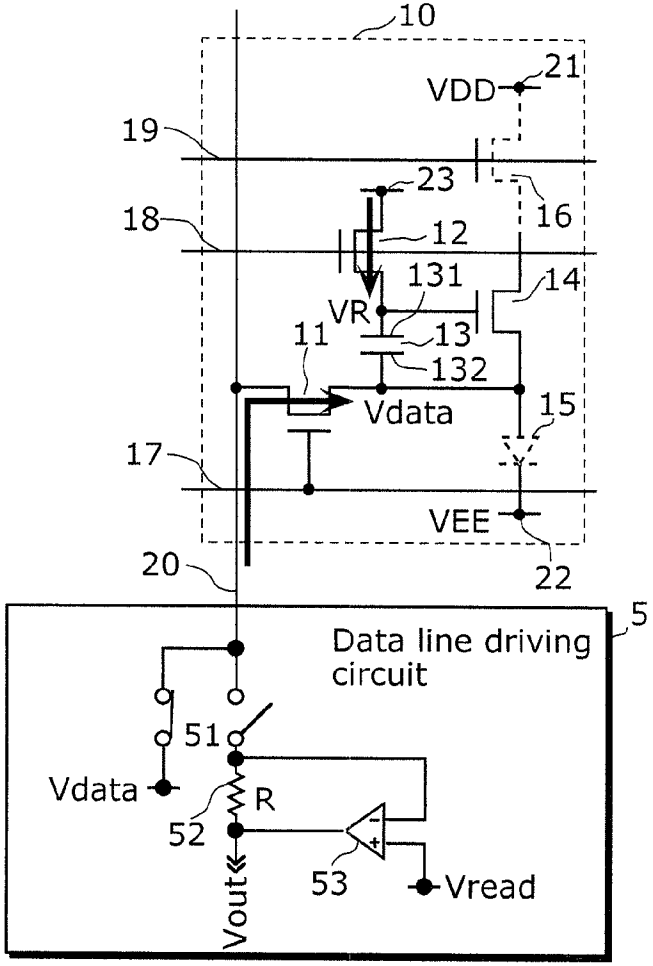
FIG. 5A is a circuit diagram showing a state of data voltage writing in the test mode of the display device according to Embodiment 1 of the present invention.

FIG. 5A is a circuit diagram showing a state of data voltage writing in the test mode of the display device according to Embodiment 1 of the present invention. As shown in the figure, a reference voltage VR of the reference power line 23 is applied to the electrode 131 of the capacitor element 13, and a data voltage Vdata is applied via the data line 20 to the electrode 132 of the same. In other words, in Steps S02 and S03, a voltage (VR−Vdata) corresponding to a data voltage to be applied to the luminescence pixel 10 is held by the capacitor element 13.

Here, a drain current of the driving transistor 14 is not generated, because the switching transistor 16 has been non-conductive. Moreover, a difference in potential between the maximum value of the data voltage Vdata and a second power supply voltage VEE is less than a threshold voltage of the organic EL element 15 (hereinafter referred to as Vth(EL)). Thus, the organic EL element 15 does not produce luminescence.

Accordingly, only a capacitive load is connected to each of the power lines, and voltage drop caused by a stationary current does not occur in a stationary state at the time of writing. Thus, an accurate potential is written into the capacitor element 13. It is to be noted that in the present embodiment, for instance, a threshold voltage Vth of a driving TFT is set as 1V, and VEE is set to 15V, VDD to 15V, VR to 10V, and Vdata between 0V and 10V inclusive.

Next, at the time t3, the scanning line driving circuit 4 changes the voltage level of the first scanning line 17 from high to low, and turns off the selection transistor 11. This causes the electrode 132 of the capacitor element 13 and the data line 20 to be non-conductive (S04 in FIG. 4).

Next, at a time t4, the scanning line driving circuit 4 changes the voltage level of the second scanning line 18 from high to low, and turns off the switching transistor 12. This causes the electrode 131 of the capacitor element 13 and the reference power line 23 to be non-conductive (S05 in FIG. 5).

The above operations make it possible to write an accurate voltage into the capacitor element 13. In subsequent operations, the drain current of the driving transistor 14 is accurately measured using the voltage accurately written into the capacitor element 13.

Next, at a time t5, the scanning line driving circuit 4 changes the voltage level of the third scanning line 19 from low to high, and turns on the switching transistor 16. This causes the drain of the driving transistor 14 and the first power line 21 to be conductive (S06 in FIG. 4).

Next, at a time t6, the scanning line driving circuit 4 changes the voltage level of the first scanning line 17 from low to high, and turns on the selection transistor 11. This causes the electrode 132 of the capacitor element 13 and the data line 20 to be conductive (S07 in FIG. 4). Each of power supply voltages is set in the test mode so that the first power supply voltage VDD-the second power supply voltage VEE<Vth (EL) is made possible. Accordingly, the drain current of the driving transistor 14 does not flow into the organic EL element 15, but flows into the data line 20 via the source of the driving transistor 14 and the electrode 132 of the capacitor element 13.

FIG. 5B is a circuit diagram showing a state of drain current reading in the test mode of the display device according to Embodiment 1 of the present invention. As shown in the figure, the data line driving circuit 5 includes a switching element 51, a reading resistance 52, and an operational amplifier 53.

The operational amplifier 53 operates to maintain equal potentials of a positive input terminal and a negative input terminal. To put it differently, the operational amplifier 53 operates so that though a pixel current Ipix which is the drain current of the driving transistor 14 flowing from the luminescence pixel 10 flows into the reading resistance 52 (R), a reading voltage Vread and a voltage of a node where the reading resistance 52 is connected to the negative input side of the operational amplifier 53 become equal. Thus, among an output potential Vout of the operational amplifier 53, the current Ipix, the reading resistance R, and the reading voltage Vread, the relationship Ipix R=Vread−Vout is established. Here, Vread is, for example, 5V.

As shown above, reading Vout makes it possible to accurately calculate Ipix. Stated differently, it is possible to accurately determine variation in Ipix for each luminescence pixel.

With the above configuration and operations, when an amount of the current supplied via the first power line 21 to the organic EL element 15 is read and measured via the data line 20, it is possible to accurately measure the amount of the current supplied via the first power line 21 to the organic EL element 15, because a condition for current to flow is same to a route from the first power line 21 to the organic EL element 15 and a route from the first power line 21 to the data line 20.

In addition, when the amount of the current supplied via the first power line 21 to the organic EL element 15 is read and measured via the data line 20, the voltage held by the capacitor element 13 is held without depending a route of Ipix, because the switching transistor 12 is in an off-state, and consequently a value of Ipix also does not depend on the route. In other words, it is possible to accurately measure the amount of the current supplied to the organic EL element 15.

Furthermore, a voltage of the second power line 22 is set to a voltage higher than a voltage obtained by subtracting Vth (EL) from a preset voltage of a power supply unit connected to the first power line 21. Consequently, when the switching transistor 16 is turned on, the drain current does not flow into the organic EL element 15, but flows from the first power line 21 to the data line 20 due to the difference in potential between the first power line 21 and the data line 20.

Finally, at a time t7, the scanning line driving unit 4 changes the voltage level of the first scanning line 17 from high to low, and turns off the selection transistor 11. This terminates the measurement of the drain current of the driving transistor 14.

The control method in the normal luminescence mode is then described below. The normal luminescence mode is a mode for writing a data voltage into the capacitor element 13 and subsequently causing the organic EL element 15 to produce luminescence by passing to the organic EL element 15 a drain current of the driving transistor 14 which is generated by a voltage corresponding to the written data voltage.

Figure 6:
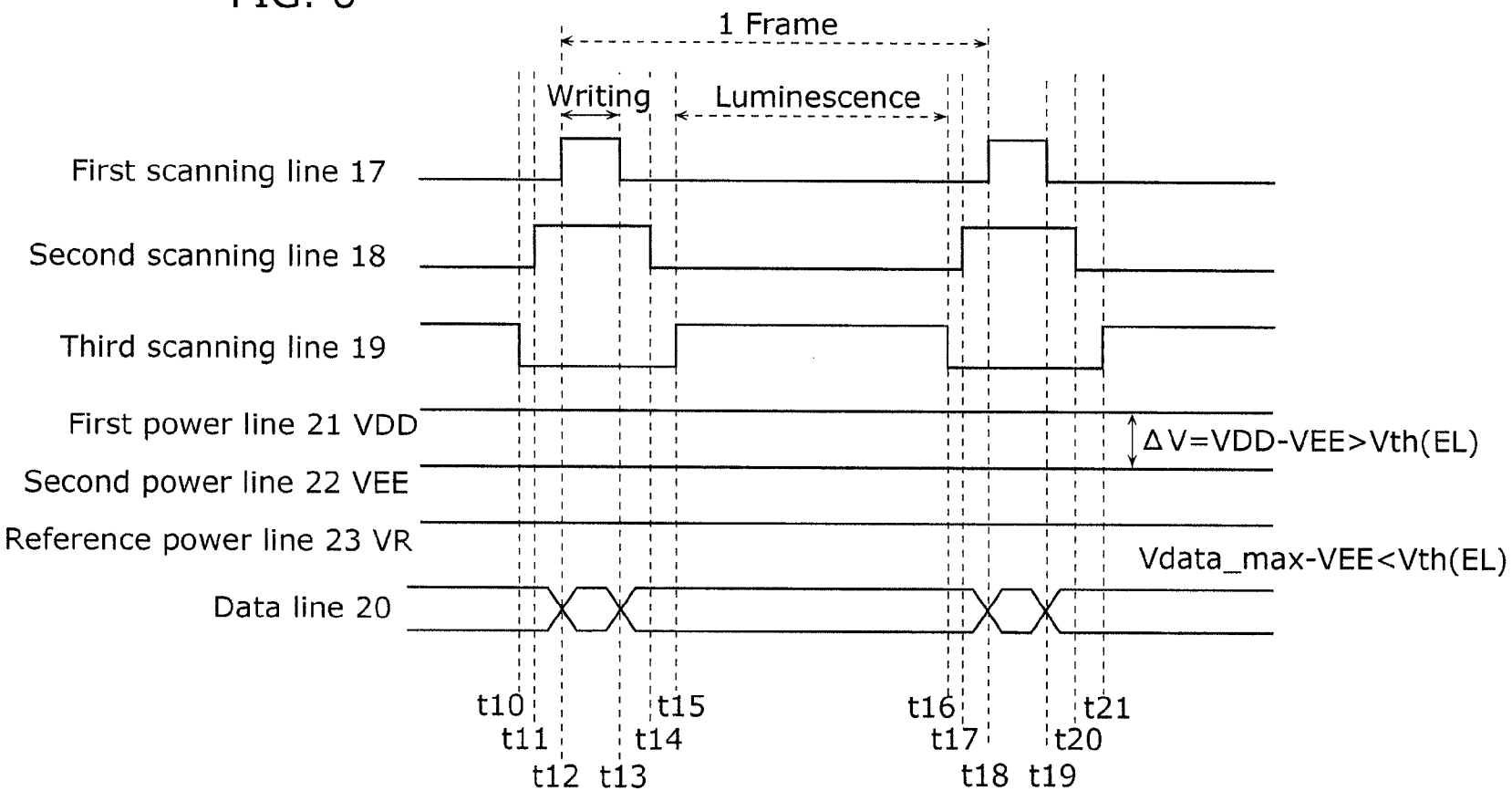
FIG. 6 is an operation timing diagram describing a control method in a normal luminescence mode of the display device according to the embodiment of the present invention.
Figure 7:
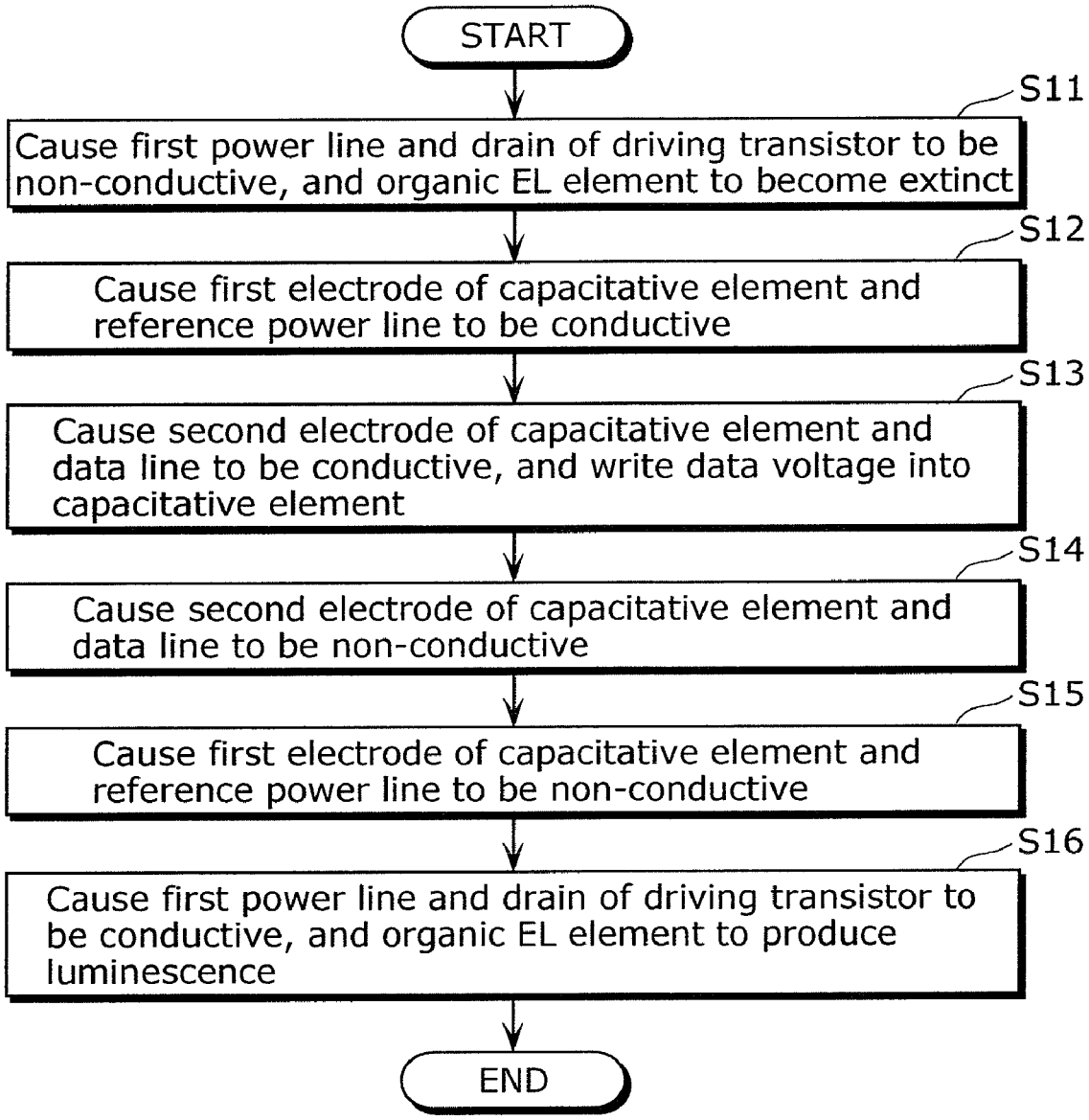
FIG. 7 is an operation flowchart describing the control method in the normal luminescence mode of the display device according to Embodiment 1 of the present invention.

FIG. 6 is an operation flowchart describing the control method in the normal luminescence mode of the display device according to Embodiment 1 of the present invention. In the figure, the horizontal axis indicates a time. Moreover, in the vertical direction, wave form charts of voltages generated in the first scanning line 17, the second scanning line 18, the third scanning line 19, the first power line 21, the second power line 22, the reference power line 23, and the data line 20 are shown in this order. FIG. 7 is an operation flowchart describing the control method in the normal luminescence mode of the display device according to Embodiment 1 of the present invention.

First, at a time t10, the scanning line driving circuit 4 changes a voltage level of the third scanning line 19 from high to low, and turns off the switching transistor 16. This causes the drain of the driving transistor 14 and the first power line 21 to be non-conductive, and the organic EL element 15 becomes extinct (S11 in FIG. 7).

Next, at a time t11, the scanning line driving circuit 4 changes a voltage level of the second scanning line 18 from low to high, and turns on the switching transistor 12. This causes the electrode 131 of the capacitor element 13 and the reference power line 23 to be conductive, and a reference voltage VR is applied to the electrode 131 of the capacitor element 13 (S12 in FIG. 7).

Next, at a time t12, the scanning line driving circuit 4 changes a voltage level of the first scanning line 17 from low to high, and turns on the switching transistor 11. This causes the electrode 132 of the capacitor element 13 and the data line 20 to be conductive, and a data voltage Vdata is applied to the electrode 132 of the capacitor element 13 (S13 in FIG. 7).

Next, during a period between the time t12 and a time t13, the data voltage Vdata and a reference voltage VR are continuously being applied to the electrodes 131 and 132 of the capacitor element 13, respectively, because the voltage level of the first scanning line 17 is high. Likewise, the data voltage is being supplied to each of the luminescence pixels belonging to the pixel row including the luminescence pixel 10.

Figure 8B:
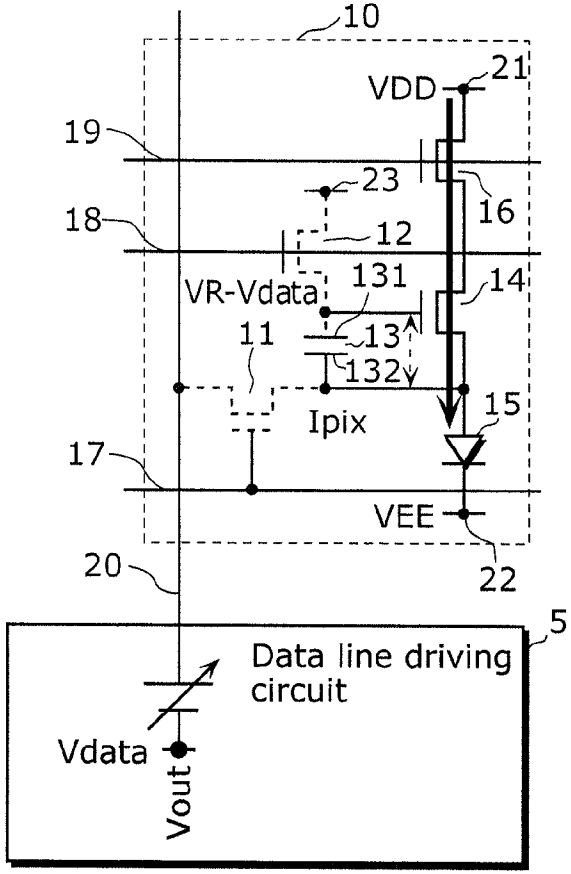
FIG. 8B is a circuit diagram showing a luminescence state in the normal luminescence mode of the display device according to Embodiment 1 of the present invention.
Figure 8A:
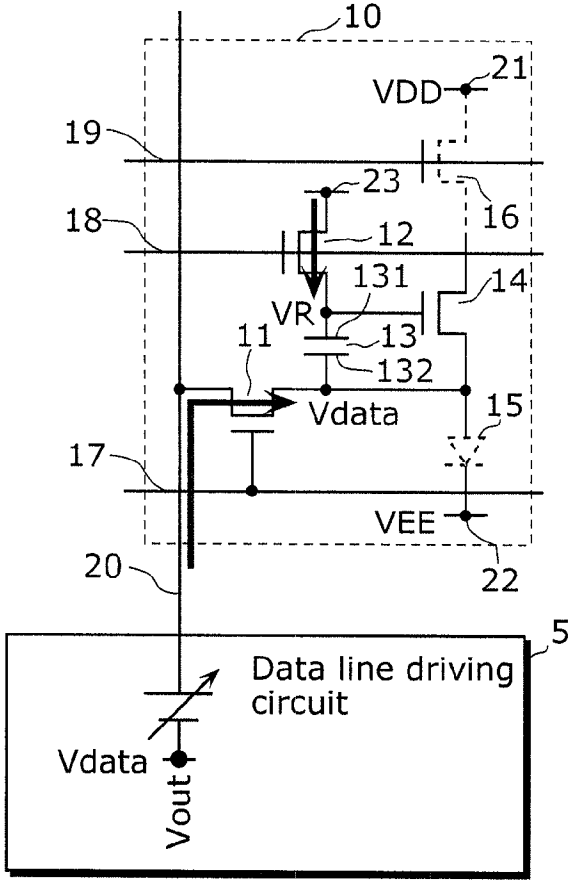
FIG. 8A is a circuit diagram showing a state of data voltage writing in the normal luminescence mode of the display device according to Embodiment 1 of the present invention.

FIG. 8A is a circuit diagram showing a state of data voltage writing in the luminescence mode of the display device according to Embodiment 1 of the present invention. As shown in the figure, a reference voltage VR of the reference power line 23 is applied to the electrode 131 of the capacitor element 13, and a data voltage Vdata is applied via the data line 20 to the electrode 132 of the same. In other words, in Steps S12 and S13, a voltage (VR−Vdata) corresponding to a data voltage to be applied to the luminescence pixel 10 is held by the capacitor element 13.

Here, a drain current of the driving transistor 14 is not generated, because the switching transistor 16 has been non-conductive. Further, a difference in potential between the maximum value of the data voltage Vdata (Vdata_max) and a second power supply voltage VEE is less than Vth(EL) of the organic EL element 15. Thus, the organic EL element 15 does not produce luminescence.

Accordingly, only a capacitive load is connected to each of the power lines, and voltage drop caused by a stationary current does not occur in a stationary state at the time of writing. Thus, an accurate potential is written into the capacitor element 13. It is to be noted that in the present embodiment, for example, a threshold voltage Vth of a driving TFT is set as 1V, and VEE is set to 0V, VDD to 15V, VR to 10V, and Vdata between 0V and 10V inclusive.

Next, at a time t13, the scanning line driving circuit 4 changes the voltage level of the first scanning line 17 from high to low, and turns off the switching transistor 11. This causes the electrode 132 of the capacitor element 13 and the data line 20 to be non-conductive (S14 in FIG. 7).

Next, at a time t14, the scanning line driving circuit 4 changes the voltage level of the second scanning line 18 from high to low, and turns off the switching transistor 12. This causes the electrode 131 of the capacitor element 13 and the reference power line 23 to be non-conductive (S15 in FIG. 7).

The above operations make it possible to write an accurate voltage into the capacitor element 13. In subsequent operations, the drain current of the driving transistor 14 which corresponds to the voltage accurately written into the capacitor element 13 is generated, and the organic EL element 15 is caused to produce luminescence.

Next, at a time t15, the scanning line driving circuit 4 changes the voltage level of the third scanning line 19 from low to high, and turns on the switching transistor 16. This causes the drain of the driving transistor 14 and the first power line 21 to be conductive, and a flow of the drain current into the organic EL element 15 causes the organic EL element 15 to produce luminescence (S16 in FIG. 7).

FIG. 8B is a circuit diagram showing a luminescence state in the normal luminescence mode of the display device according to Embodiment 1 of the present invention. Each of power supply voltages is set in the normal luminescence mode so that the first power supply voltage VDD-the second power supply voltage VEE>Vth(EL) is made possible. Accordingly, the drain current of the driving transistor 14 which corresponds to the voltage held in the both electrodes of the capacitor element 13 flows into the organic EL element 15.

Next, at a time t16, the scanning line driving circuit 4 changes the voltage level of the third scanning line 19 from high to low, turns off the switching transistor 16, and causes the organic EL element 15 to become extinct.

The above-mentioned times t10 to t16 correspond to one frame period of a display panel, and the same operations as at t10 to t15 are performed at t16 to t21.

The above circuit configuration and operations make it possible to cause the capacitor element 13 to hold the voltage having the desired difference in potential after the switching transistor 16 interrupts a current flowing between the first power line 21 and the data line 20 via the source of the driving transistor 14 and the selection transistor 11. This prevents the difference in potential between the both terminals of the selection transistor 11 from varying depending on the current flowing between the first power line 21 and the data line 20 via the source of the driving transistor 14 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. As a result, the difference in potential between the gate and the source of the driving transistor 14 is not easily influenced by a voltage variation of the second power line 22 and a source potential variation of the driving transistor 14 which is caused by an increase in resistance with time degradation of the organic EL element 15. In other words, this circuit operation becomes an operation identical to a source grounding circuit operation, and the drain current corresponding to the voltage having the desired difference in potential can be accurately passed to the organic EL element 15.

Embodiment 2

The following describes in detail Embodiment 2 of the present invention with reference to the drawings.

FIG. 1 is a block diagram showing the electrical configuration of the display device of the present invention. The display device 1 in the figure includes the control circuit 2, the memory 3, the scanning line driving circuit 4, the data line driving circuit 5, the power line driving circuit 6, and the display unit 7.

Figure 9:
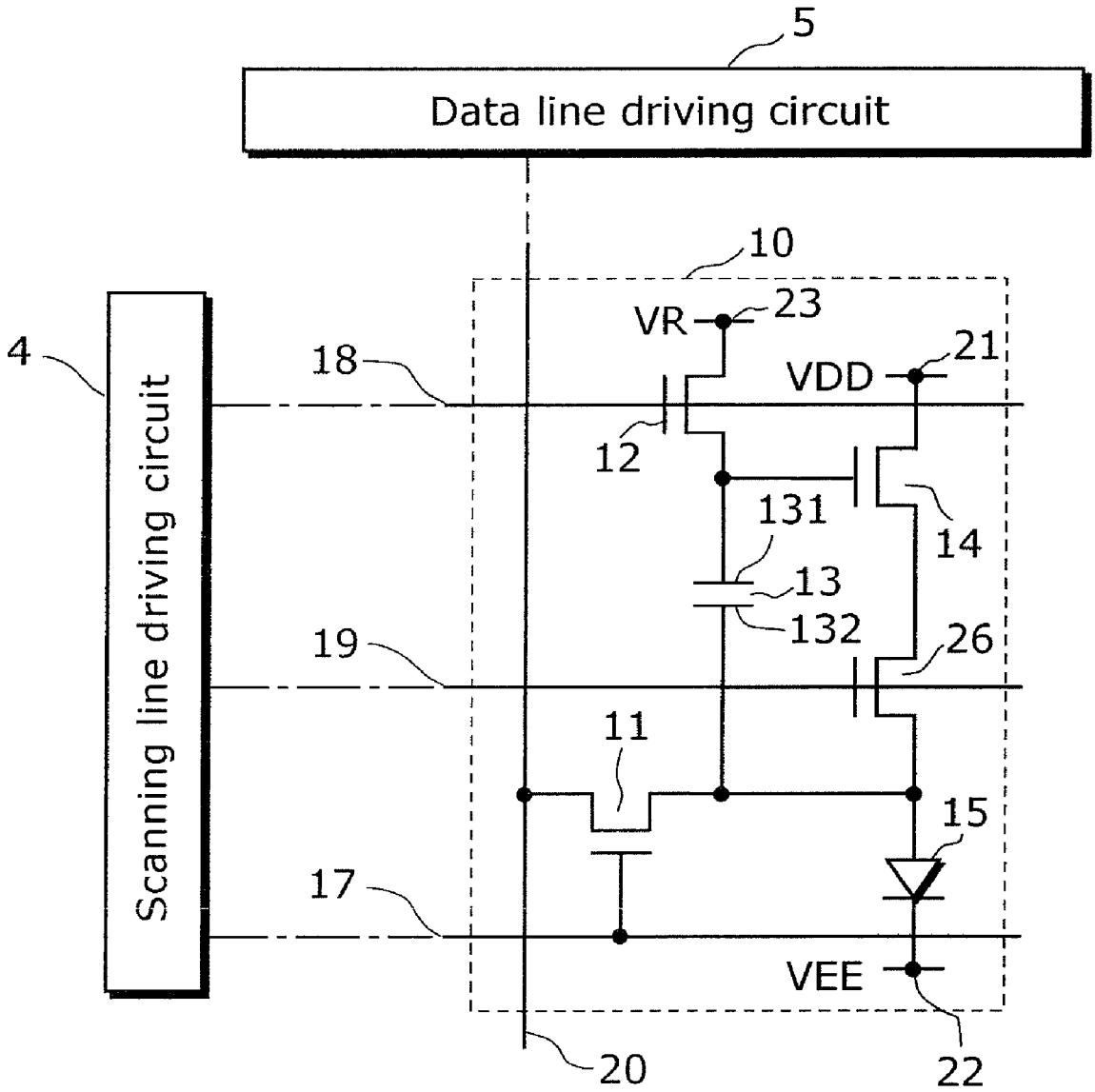
FIG. 9 is a diagram showing a circuit configuration of a luminescence pixel included in a display unit according to Embodiment 2 of the present invention, and connection between the luminescence pixel and peripheral circuitry thereof.

FIG. 9 is a diagram showing a circuit configuration of a luminescence pixel included in a display unit according to Embodiment 2 of the present invention, and connection between the luminescence pixel and peripheral circuitry thereof. A luminescence pixel 10 in the figure includes a selection transistor 11, switching transistors 12 and 26, a capacitor element 13, a driving transistor 14, an organic EL element 15, a first scanning line 17, a second scanning line 18, a third scanning line 19, a data line 20, a first power line 21, a second power line 22, and a reference power line 23. In addition, the peripheral circuitry includes the scanning line driving circuit 4 and the data line driving circuit 5.

In comparison with the display device according to Embodiment 1, the display device according to the present embodiment differs only in a circuit configuration of luminescence pixels. Hereinafter, descriptions of similarities to the display device according to Embodiment 1 are omitted, and only differences from the display device according to Embodiment 1 are described.

The control circuit 2 functions to control the scanning line driving circuit 4, the data line driving circuit 5, the power line driving circuit 6, and the memory 3. The memory 3 stores, for example, correction data of each of luminescence pixels, and the control circuit 2 reads the correction data written into the memory 3, corrects an externally inputted video signal based on the correction data, and outputs the corrected video signal to the data line driving circuit 5.

Furthermore, the control circuit 2 controls via the scanning line driving circuit 4 the selection transistor 11 and the switching transistors 12 and 26.

The scanning line driving circuit 4 is connected to the first scanning line 17, the second scanning line 18, and the third scanning line 19, and functions to perform control on conduction and non-conduction of the selection transistor 11 and the switching transistors 12 and 26 included in the luminescence pixel 10 by respectively outputting scanning signals to the first scanning line 17, the second scanning line 18, and the third scanning line 19, according to an instruction from the control circuit 2.

The driving transistor 14 is a driving element having a gate connected to an electrode 131 of the capacitor element 13, a drain connected to the first power line 21, and a source connected to one of a source and a drain of the switching transistor 26. The driving transistor 14 transforms a voltage corresponding to a data voltage applied to between the gate and the other one of the source and the drain of the switching transistor 26 into a drain current corresponding to the data voltage. Then, the driving transistor 14 supplies the drain current as a signal current to the organic EL element 15. For example, when the selection transistor 11 and the switching transistor 12 are in an off-state and the switching transistor 26 is in an on-state, the driving transistor 14 functions to supply to the organic EL element 15 a voltage corresponding to a data voltage Vdata supplied from the data line 20, that is, a drain current corresponding to the voltage (VR−Vdata) held by the capacitor element 13. The driving transistor 14 is configured by, for instance, an n-type thin-film transistor (n-type TFT).

The organic EL element 15 is a luminescence element having an anode connected to the other one of the source and the drain of the driving transistor 26 and a cathode connected to the second power line 22. A flow of the drain current, the signal current, from the driving transistor 14 causes the organic EL element 15 to produce luminescence.

The switching transistor 26 is a third switching element having a gate connected to the third scanning line 19, one of a source and a drain connected to the source of the driving transistor 14, and the other one of the source and drain connected to the anode of the organic EL element 15. The switching transistor 26 is provided between the anode of the organic EL element 15 and the first power line 21, connected in series with the driving transistor 14, and functions to determine turning on or off of the drain current of the driving transistor 14. The switching transistor 26 is configured by, for example, an n-type thin-film transistor (n-type TFT).

The third scanning line 19 is connected to the scanning line driving circuit 4, and to each of luminescence pixels belonging to a pixel row including the luminescence pixel 10. Accordingly, the third scanning line 19 functions to electrically connect the anode of the organic EL element 15 and the source of the driving transistor 14 included in each of the luminescence pixels belonging to the pixel row including the luminescence pixel 10.

The above circuit configuration makes it possible to cause the capacitor element 13 to hold a voltage having a desired difference in potential after the switching transistor 26 interrupts a current flowing between the first power line 21 and the data line 20 via the source of the driving transistor 14 and the selection transistor 11. This prevents the difference in potential between the both terminals of the selection transistor 11 from varying depending on the current flowing between the first power line 21 and the data line 20 via the source of the driving transistor 14 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. As a result, the difference in potential between the gate and the source of the driving transistor 14 is stabilized, and the drain current corresponding to the voltage having the desired difference in potential can be accurately passed to the organic EL element 15.

Next, the following describes the control method of the display device according to the present embodiment with reference to FIGS. 3, 6, and 10 to 13B.

Figure 10:
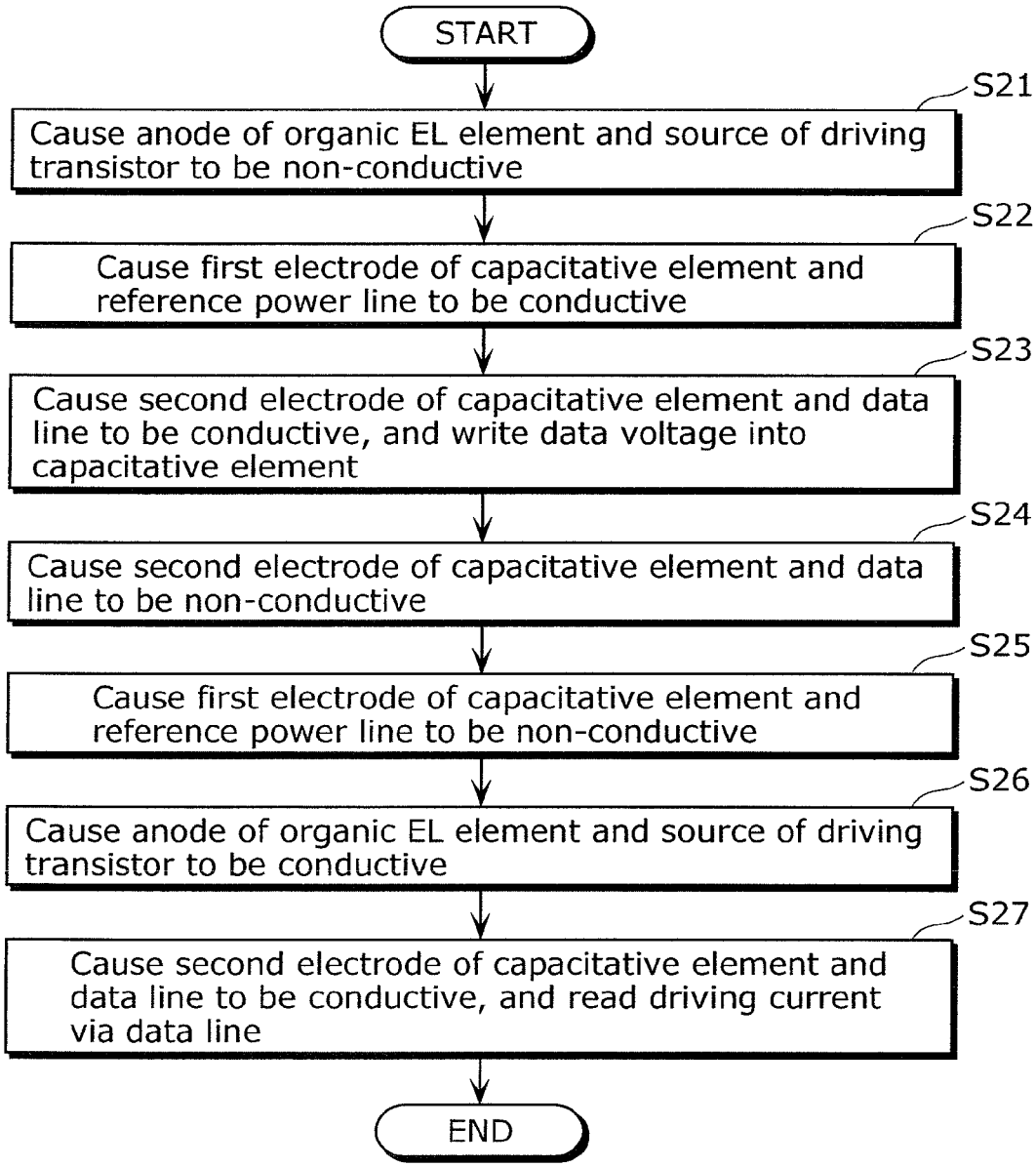
FIG. 10 is an operation flowchart describing a control method in a test mode of a display device according to Embodiment 2 of the present invention.
Figure 11B:
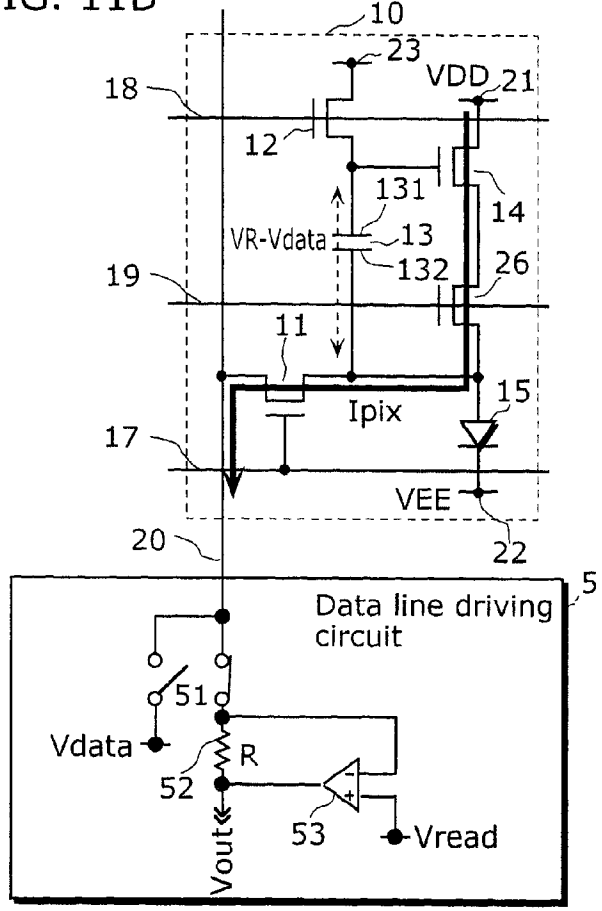
FIG. 11B is a circuit diagram showing a state of drain current reading in the test mode of the display device according to Embodiment 2 of the present invention.
Figure 12:
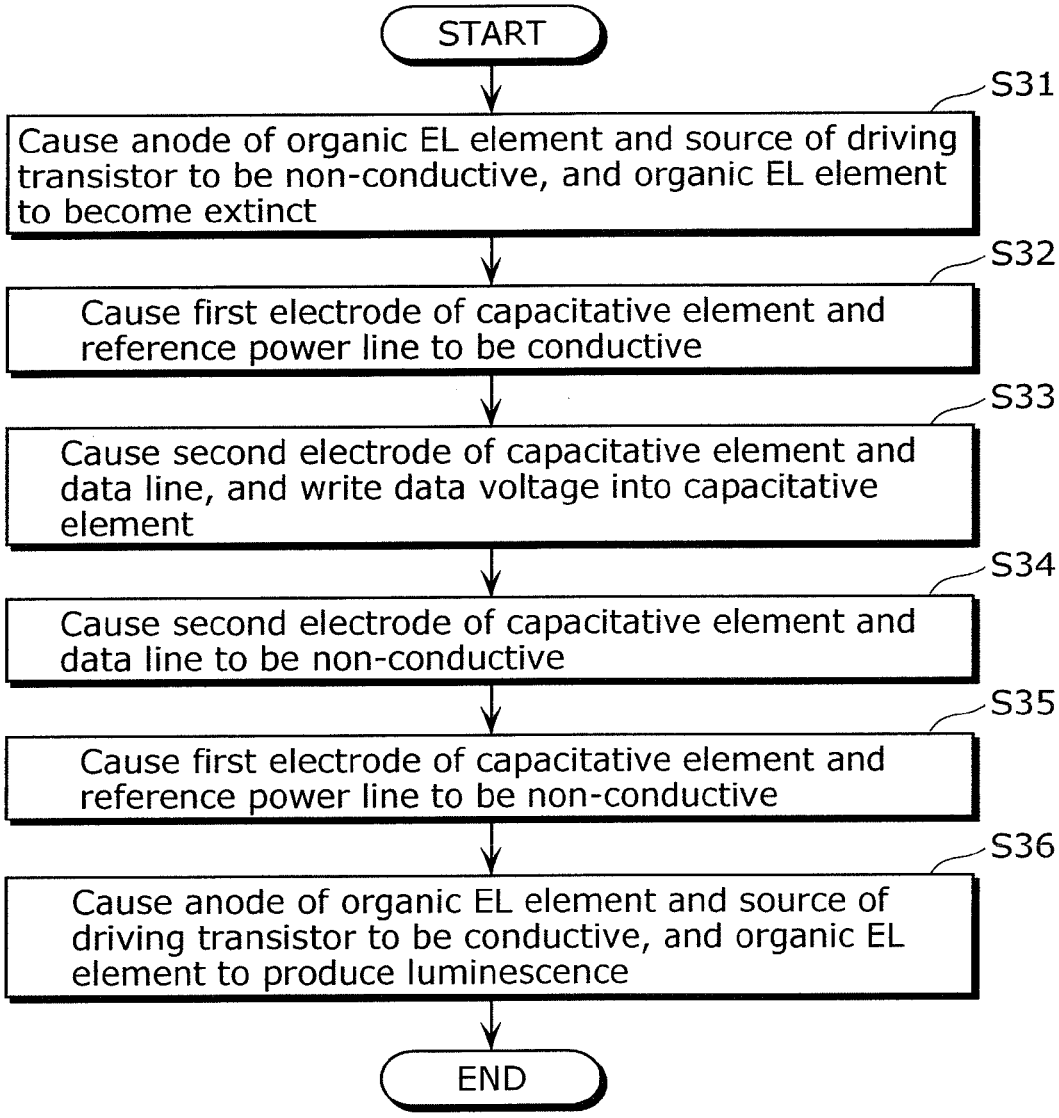
FIG. 12 is an operation flowchart describing a control method in a normal luminescence mode of the display device according to Embodiment 2 of the present invention.
Figure 13B:
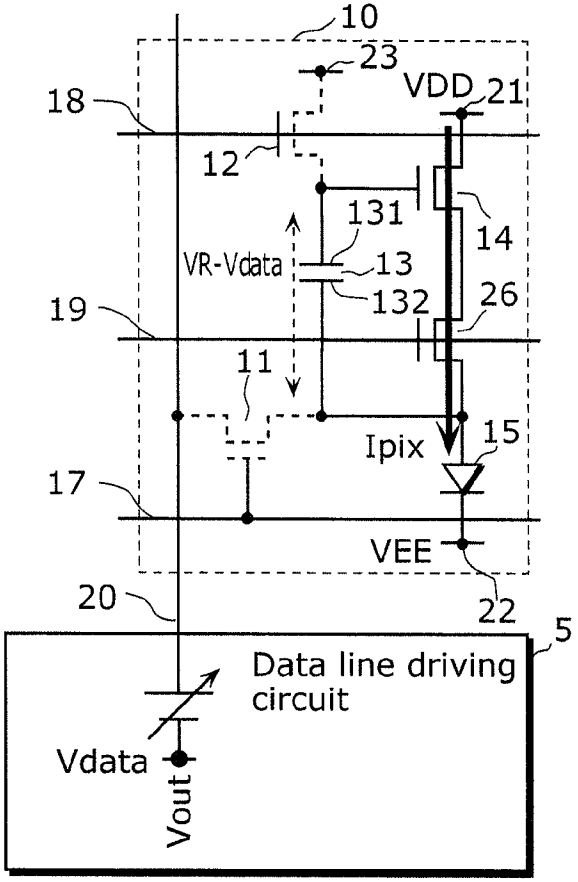
FIG. 13B is a circuit diagram showing a luminescence state in the normal luminescence mode of the display device according to Embodiment 2 of the present invention.

FIGS. 3, 10, and 11B describe the control method in a test mode, and FIGS. 6, 12, and 13B describe the control method in a normal luminescence mode.

First, the control method in the test mode is described below

FIG. 3 is the operation flowchart describing the control method in the test mode of the display device according to Embodiment 1 of the present invention.

First, at a time t0, the scanning line driving circuit 4 changes a voltage level of the third scanning line 19 from high to low, and turns off the switching transistor 26. This causes the anode of the organic EL element 15 and the source of the driving transistor 14 to be non-conductive (S21 in FIG. 10).

Next, at a time t1, the scanning line driving circuit 4 changes a voltage level of the second scanning line 18 from low to high, and turns on the switching transistor 12. This causes the electrode 131 of the capacitor element 13 and the reference power line 23 to be conductive, and a reference voltage VR is applied to the electrode 131 of the capacitor element 13 (S22 in FIG. 10).

Next, at a time t2, the scanning line driving circuit 4 changes a voltage level of the first scanning line 17 from low to high, and turns on the switching transistor 11. This causes the electrode 132 of the capacitor element 13 and the data line 20 to be conductive, and a data voltage Vdata is applied to the electrode 132 of the capacitor element 13 (S23 in FIG. 10).

Next, during a period between the time t2 and a time t3, the data voltage Vdata and the reference voltage VR are continuously being applied to the electrodes 131 and 132 of the capacitor element 13, respectively, because the voltage level of the first scanning line 17 is high. Likewise, the data voltage is being supplied to each of the luminescence pixels belonging to the pixel row including the luminescence pixel 10.

Figure 11A:
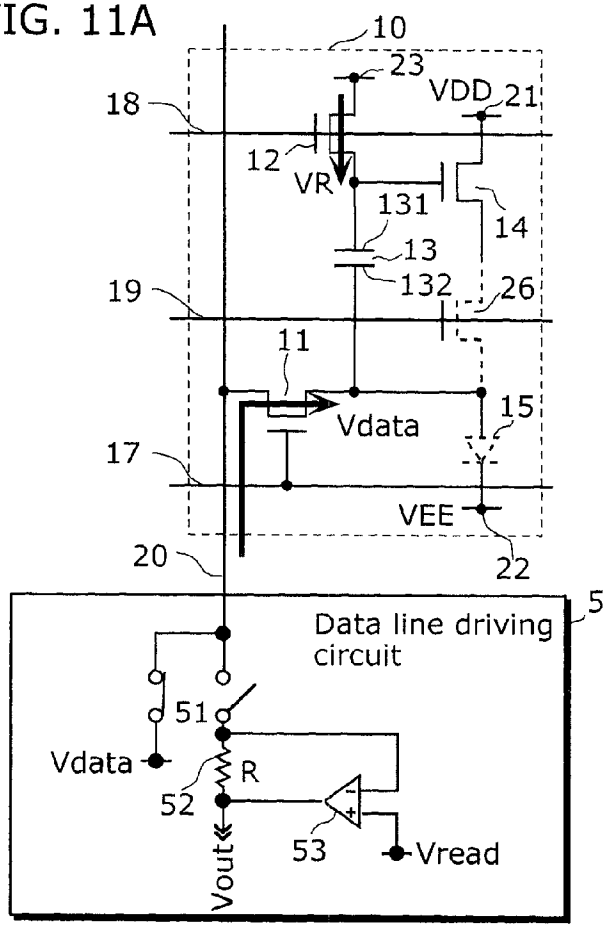
FIG. 11A is a circuit diagram showing a state of data voltage writing in the test mode of the display device according to Embodiment 2 of the present invention.

FIG. 11A is a circuit diagram showing a state of data voltage writing in the test mode of the display device according to Embodiment 2 of the present invention. As shown in the figure, a reference voltage VR of the reference power line 23 is applied to the electrode 131 of the capacitor element 13, and a data voltage Vdata is applied via the data line 20 to the electrode 132 of the same. In other words, in Steps S22 and S23, a voltage (VR−Vdata) corresponding to a data voltage to be applied to the luminescence pixel 10 is held by the capacitor element 13.

Here, a drain current of the driving transistor 14 is not generated, because the switching transistor 26 has been non-conductive. Moreover, a difference in potential between the maximum value of the data voltage Vdata and a second power supply voltage VEE is less than a threshold voltage of the organic EL element 15 (hereinafter referred to as Vth(EL)). Thus, the organic EL element 15 does not produce luminescence.

Accordingly, only a capacitive load is connected to each of the power lines, and voltage drop caused by a stationary current does not occur in a stationary state at the time of writing. Thus, an accurate potential is written into the capacitor element 13. It is to be noted that in the present embodiment, for instance, a threshold voltage Vth of a driving TFT is set as 1V, and VEE is set to 15V, VDD to 15V, VR to 10V, and Vdata between 0V and 10V inclusive.

Next, at the time t3, the scanning line driving circuit 4 changes the voltage level of the first scanning line 17 from high to low, and turns off the selection transistor 11. This causes the electrode 132 of the capacitor element 13 and the data line 20 to be non-conductive (S24 in FIG. 10).

Next, at a time t4, the scanning line driving circuit 4 changes the voltage level of the second scanning line 18 from high to low, and turns off the switching transistor 12. This causes the electrode 131 of the capacitor element 13 and the reference power line 23 to be non-conductive (S25 in FIG. 10).

The above operations make it possible to write an accurate voltage into the capacitor element 13. In subsequent operations, the drain current of the driving transistor 14 is accurately measured using the voltage accurately written into the capacitor element 13.

Next, at a time t5, the scanning line driving circuit changes the voltage level of the third scanning line 19 from low to high, and turns on the switching transistor 26. This causes the anode of the organic EL element 15 and the source of the driving transistor 14 to be conductive (S26 in FIG. 10).

Next, at a time t6, the scanning line driving circuit 4 changes the voltage level of the first scanning line 17 from low to high, and turns on the selection transistor 11. This causes the electrode 132 of the capacitor element 13 and the data line 20 to be conductive (S27 in FIG. 10). Each of power supply voltages is set in the test mode so that the first power supply voltage VDD-the second power supply voltage VEE<Vth (EL) is made possible. Accordingly, the drain current of the driving transistor 14 does not flow into the organic EL element 15, but flows into the data line 20 via the source of the driving transistor 14 and the electrode 132 of the capacitor element 13.

FIG. 11B is a circuit diagram showing a state of drain current reading in the test mode of the display device according to Embodiment 2 of the present invention. As shown in the figure, the data line driving circuit 5 includes a switching element 51, a reading resistance 52, and an operational amplifier 53.

The operational amplifier 53 operates to maintain equal potentials of a positive input terminal and a negative input terminal. To put it differently, the operational amplifier 53 operates so that though a pixel current Ipix which is the drain current of the driving transistor 14 flowing from the luminescence pixel 10 flows into the reading resistance 52 (R), a reading voltage Vread and a voltage of a node where the reading resistance 52 is connected to the negative input side of the operational amplifier 53 become equal. Thus, among an output potential Vout of the operational amplifier 53, the current Ipix, the reading resistance R, and the reading voltage Vread, the relationship Ipix R=Vread−Vout is established. Here, Vread is, for instance, 5V.

As shown above, reading Vout makes it possible to accurately calculate Ipix. Stated differently, it is possible to accurately determine variation in Ipix for each luminescence pixel.

With the above configuration and operations, when an amount of the current supplied via the first power line 21 to the organic EL element 15 is read and measured via the data line 20, it is possible to accurately measure the amount of the current supplied via the first power line 21 to the organic EL element 15, because a condition for current to flow is same to a route from the first power line 21 to the organic EL element 15 and a route from the first power line 21 to the data line 20.

In addition, when the amount of the current supplied via the first power line 21 to the organic EL element 15 is read and measured via the data line 20, the voltage held by the capacitor element 13 is held without depending on a route of Ipix, because the switching transistor 12 is in an off-state, and consequently a value of Ipix also does not depend on the route. In other words, it is possible to accurately measure the amount of the current supplied to the organic EL element 15.

Furthermore, a voltage of the second power line 22 is set to a voltage higher than a voltage obtained by subtracting Vth (EL) from a preset voltage of a power supply unit connected to the first power line 21. Consequently, when the switching transistor 26 is turned on, the drain current does not flow into the organic EL element 15, but flows from the first power line 21 to the data line 20 due to the difference in potential between the first power line 21 and the data line 20.

Finally, at a time t7, the scanning line driving unit 4 changes the voltage level of the first scanning line 17 from high to low, and turns off the selection transistor 11. This terminates the measurement of the drain current of the driving transistor 14.

The control method in the normal luminescence mode is then described below.

FIG. 6 is the operation flowchart describing the control method in the normal luminescence mode of the display device according to Embodiment 2 of the present invention.

First, at a time t10, the scanning line driving circuit 4 changes a voltage level of the third scanning line 19 from high to low, and turns off the switching transistor 26. This causes the anode of the organic EL element 15 and the source of the driving transistor 14 to be non-conductive, and the organic EL element 15 to become extinct (S31 in FIG. 12).

Next, at a time t11, the scanning line driving circuit 4 changes a voltage level of the second scanning line 18 from low to high, and turns on the switching transistor 12. This causes the electrode 131 of the capacitor element 13 and the reference power line 23 to be conductive, and a reference voltage VR is applied to the electrode 131 of the capacitor element 13 (S32 in FIG. 12).

Next, at a time t12, the scanning line driving circuit 4 changes a voltage level of the first scanning line 17 from low to high, and turns on the switching transistor 11. This causes the electrode 132 of the capacitor element 13 and the data line 20 to be conductive, and a data voltage Vdata is applied to the electrode 132 of the capacitor element 13 (S33 in FIG. 12).

Next, during a period between the time t12 and a time t13, the data voltage Vdata and a reference voltage VR are continuously being applied to the electrodes of 131 and 132 of the capacitor element 13, respectively, because the voltage level of the first scanning line 17 is high. Likewise, the data voltage is being supplied to each of the luminescence pixels belonging to the pixel row including the luminescence pixel 10.

Figure 13A:
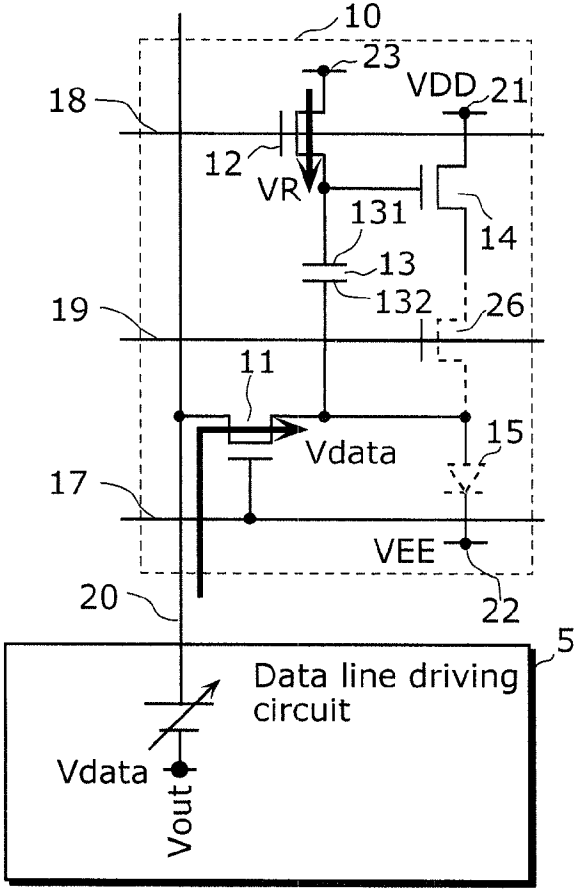
FIG. 13A is a circuit diagram showing a state of data voltage writing in the normal luminescence mode of the display device according to Embodiment 2 of the present invention.

FIG. 13A is a circuit diagram showing a state of data voltage writing in the normal luminescence mode of the display device according to Embodiment 2 of the present invention. As shown in the figure, a reference voltage VR of the reference power line 23 is applied to the electrode 131 of the capacitor element 13, and a data voltage Vdata is applied via the data line 20 to the electrode 132 of the same. In other words, in Steps S32 and S33, a voltage (VR−Vdata) corresponding to a data voltage to be applied to the luminescence pixel 10 is held by the capacitor element 13.

Here, a drain current of the driving transistor 14 is not generated, because the switching transistor 26 has been non-conductive. Further, a difference in potential between the maximum value of the data voltage Vdata (Vdata_max) and a second power supply voltage VEE is less than Vth(EL) of the organic EL element 15. Thus, the organic EL element 15 does not produce luminescence.

Accordingly, only a capacitive load is connected to each of the power lines, and voltage drop caused by a stationary current does not occur in a stationary state at the time of writing. Thus, an accurate potential is written into the capacitor element 13. It is to be noted that in the present embodiment, for example, a threshold voltage Vth of a driving TFT is set as 1V, and VEE is set to 0V, VDD to 15V, VR to 10V, and Vdata between 0V and 10V inclusive.

Next, at a time t13, the scanning line driving circuit 4 changes the voltage level of the first scanning line 17 from high to low, and turns off the switching transistor 11. This causes the electrode 132 of the capacitor element 13 and the data line 20 to be non-conductive (S34 in FIG. 12).

Next, at a time t14, the scanning line driving circuit 4 changes the voltage level of the second scanning line 18 from high to low, and turns off the switching transistor 12. This causes the electrode 131 of the capacitor element 13 and the reference power line 23 to be non-conductive (S35 in FIG. 12).

The above operations make it possible to write an accurate voltage into the capacitor element 13. In subsequent operations, the drain current of the driving transistor 14 which corresponds to the voltage accurately written into the capacitor element 13 is generated, and the organic EL element 15 is caused to produce luminescence.

Next, at a time t15, the scanning line driving circuit 4 changes the voltage level of the third scanning line 19 from low to high, and turns on the switching transistor 26. This causes the anode of the organic EL element 15 and the source of the driving transistor 14 to be conductive, and a flow of the drain current into the organic EL element 15 causes the organic EL element 15 to produce luminescence (S36 in FIG. 12).

FIG. 13B is a circuit diagram showing a luminescence state in the normal luminescence mode of the display device according to Embodiment 2 of the present invention. Each of power supply voltages is set in the normal luminescence mode so that the first power supply voltage VDD-the second power supply voltage VEE>Vth(EL) is made possible. Accordingly, the drain current of the driving transistor 14 which corresponds to the voltage held in the both electrodes of the capacitor element 13 flows into the organic EL element 15.

Next, at a time t16, the scanning line driving circuit 4 changes the voltage level of the third scanning line 19 from high to low, turns off the switching transistor 26, and causes the organic EL element 15 to become extinct.

The above circuit configuration and operations make it possible to cause the capacitor element 13 to hold the voltage having the desired difference in potential after the switching transistor 26 interrupts a current flowing between the first power line 21 and the data line 20 via the source of the driving transistor 14 and the selection transistor 11. This prevents the difference in potential between the both terminals of the selection transistor 11 from varying depending on the current flowing between the first power line 21 and the data line 20 via the source of the driving transistor 14 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. As a result, the difference in potential between the gate and the source of the driving transistor 14 is not easily influenced by a voltage variation of the second power line 22 and a source potential variation of the driving transistor 14 which is caused by an increase in resistance with time degradation of the organic EL element 15. In other words, this circuit operation becomes an operation identical to a source grounding circuit operation, and the drain current corresponding to the voltage having the desired difference in potential can be accurately passed to the organic EL element 15.

Embodiment 3

The following describes in detail Embodiment 3 of the present invention with reference to the drawings.

Figure 14:
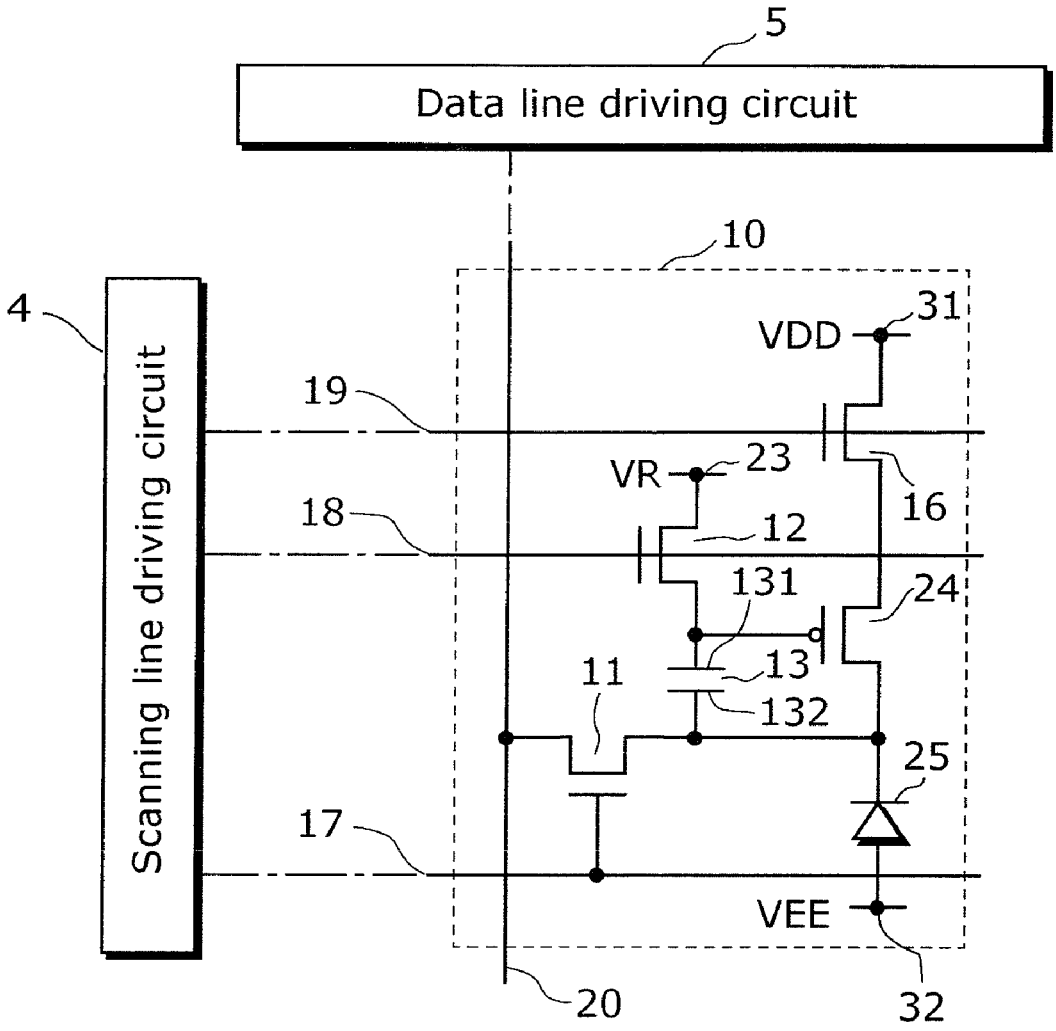
FIG. 14 is a diagram showing a circuit configuration of a luminescence pixel included in a display unit according to Embodiment 3 of the present invention, and connection between the luminescence pixel and peripheral circuitry thereof.

FIG. 14 is a diagram showing a circuit configuration of a luminescence pixel included in a display unit according to Embodiment 3 of the present invention, and connection between the luminescence pixel and peripheral circuitry thereof. A luminescence pixel 10 in the figure includes a selection transistor 11, switching transistors 12 and 16, a capacitor element 13, a driving transistor 24, an organic EL element 25, a first scanning line 17, a second scanning line 18, a third scanning line 19, a data line 20, a first power line 31, a second power line 32, and a reference power line 23. In addition, the peripheral circuitry includes a scanning line driving circuit 4 and a data line driving circuit 5.

In comparison with the display device according to Embodiment 1, the display device according to the present embodiment differs only in a circuit configuration of luminescence pixels. In other words, a driving transistor is a p-type transistor having a source connected to a cathode of an organic EL element. Hereinafter, descriptions of similarities to the display device according to Embodiment 1 are omitted, and only differences from the display device according to Embodiment 1 are described.

The driving transistor 24 is a driving element having a gate connected to an electrode 131 of the capacitor element 13, a drain connected to one of a source and a drain of the switching transistor 16, and a source connected to a cathode that is a first electrode of the organic EL element 25. The driving transistor 24 transforms a voltage corresponding to a data voltage applied to between the gate and the source into a drain current corresponding to the data voltage. Then, the driving transistor 14 supplies the drain current as a signal current to the organic EL element 25. For example, when the selection transistor 11 and the switching transistor 12 are in an off-state and the switching transistor 16 is in an on-state, the driving transistor 24 functions to supply to the organic EL element 25 a voltage corresponding to a data voltage Vdata supplied from the data line 20, that is, a drain current corresponding to a voltage (VR−Vdata) held by the capacitor element 13. The driving transistor 24 is configured by a p-type thin-film transistor (p-type TFT).

The organic EL element 25 is a luminescence element having the cathode connected to the source of the driving transistor 24 and an anode connected to the second power line 32, and a flow of the drain current of the driving transistor 24 into the organic EL element 25 causes the organic EL element 25 to produce luminescence.

The switching transistor 16 is a third switching element having a gate connected to the third scanning line 19, one of a source and a drain connected to the drain of the driving transistor 24, and the other one connected to the first power line 31. The switching transistor 16 is provided between the cathode of the organic EL element 25 and the first power line 31, connected in series with the driving transistor 24, and functions to determine turning on or off of the drain current of the driving transistor 24. The switching transistor 16 is configured by, for example, an n-type thin-film transistor (n-type TFT).

The above circuit configuration makes it possible to cause the capacitor element 13 to hold a voltage having a desired difference in potential after the switching transistor 16 interrupts a current flowing between the first power line 31 and the data line 20 via the source of the driving transistor 24 and the selection transistor 11. This prevents the difference in potential between the both terminals of the selection transistor 11 from varying depending on the current flowing between the first power line 21 and the data line 20 via the source of the driving transistor 24 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. Consequently, the difference in potential between the both electrodes of the capacitor element 13, that is, the difference in potential between the gate and the source of the driving transistor 24 is stabilized, and the drain current corresponding to the voltage having the desired difference in potential can be accurately passed to the organic EL element 25.

The control method of the display device according to the present embodiment is same as that of the display device according to Embodiment 1, and produces the same advantageous effects as those of the display device according to Embodiment 1.

However, in the test mode, a difference in potential between a second power supply voltage VEE and the maximum value of a data voltage Vdata is less than a threshold voltage of the organic EL element 25 (hereinafter referred to as Vth(EL)).

In addition, each of power supply voltages is set in the test mode so that the second power supply voltage VEE-the first power supply voltage VDD<Vth(EL) is made possible. Accordingly, the drain current of the driving transistor 24 does not flow into the organic EL element 25, but flows into the data line 20 via the source of the driving transistor 24 and an electrode 132 of the capacitor element 13.

Furthermore, at the time of the drain current reading in the test mode, a current Ipix flows from the data line 20 to the first power line 31 via the selection transistor 11 and the source of the driving transistor 24.

Moreover, in the normal luminescence mode, a difference in potential between the second power supply voltage VEE and the minimum value of the data voltage Vdata (Vdata min) is less than the Vth(EL) of the organic EL element 25

Furthermore, each of the power supply voltages is set in the normal luminescence mode so that the second power supply voltage VEE-the first power supply voltage VDD>Vth(EL) is made possible. Accordingly, the drain current of the driving transistor 24 which corresponds to the voltage held in the both electrodes of the capacitor element 13 flows into the organic EL element 25.

The above circuit configuration makes it possible to cause the capacitor element 13 to hold the voltage having the desired difference in potential after the switching transistor 16 interrupts a current flowing between the first power line 31 and the data line 20 via the source of the driving transistor 24 and the selection transistor 11. This prevents the difference in potential between the both terminals of the selection transistor 11 from varying depending on the current flowing between the first power line 31 and the data line 20 via the source of the driving transistor 24 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. As a result, this circuit operation becomes identical to a source grounding circuit operation in which the difference in potential between the gate and the source of the driving transistor 24 is not easily influenced by a voltage variation of the second power line 32 and a source potential variation of the driving transistor 24 that is caused by an increase in resistance with time degradation of the organic EL element 25, and the drain current corresponding to the voltage having the desired difference in potential can be accurately passed to the organic EL element 25.

Embodiment 4

The following describes in detail Embodiment 4 of the present invention with reference to the drawings.

Figure 15:
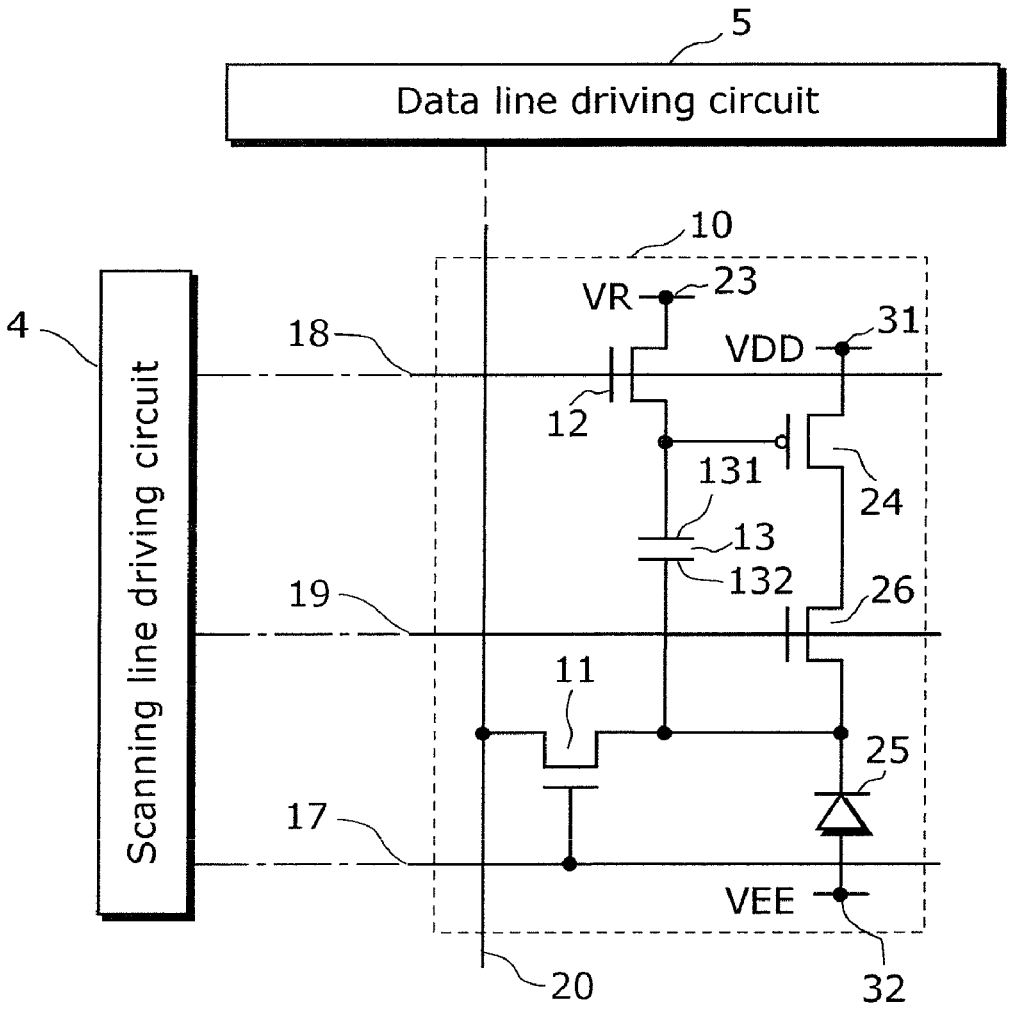
FIG. 15 is a diagram showing a circuit configuration of a luminescence pixel included in a display unit according to Embodiment 4 of the present invention, and connection between the luminescence pixel and peripheral circuitry thereof.
Figure 16:
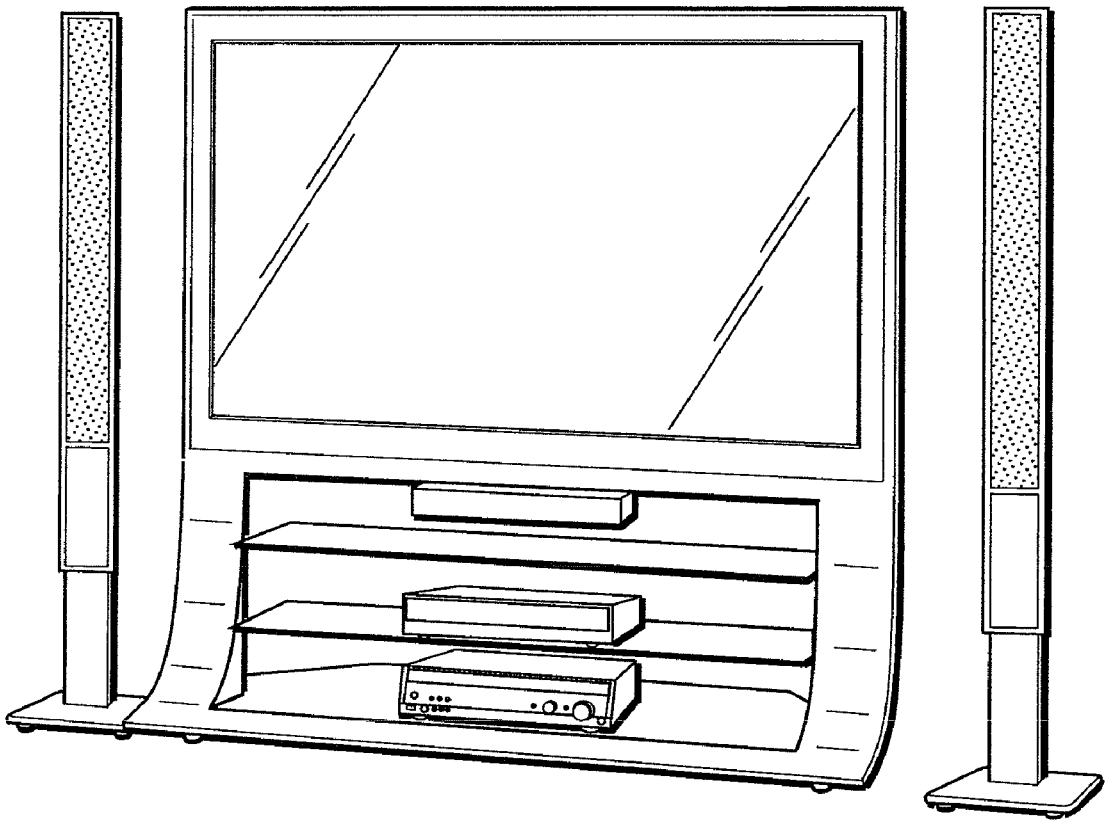
FIG. 16 is an external view of a flat-screen TV including the image display device of the present invention.
Figure 17:
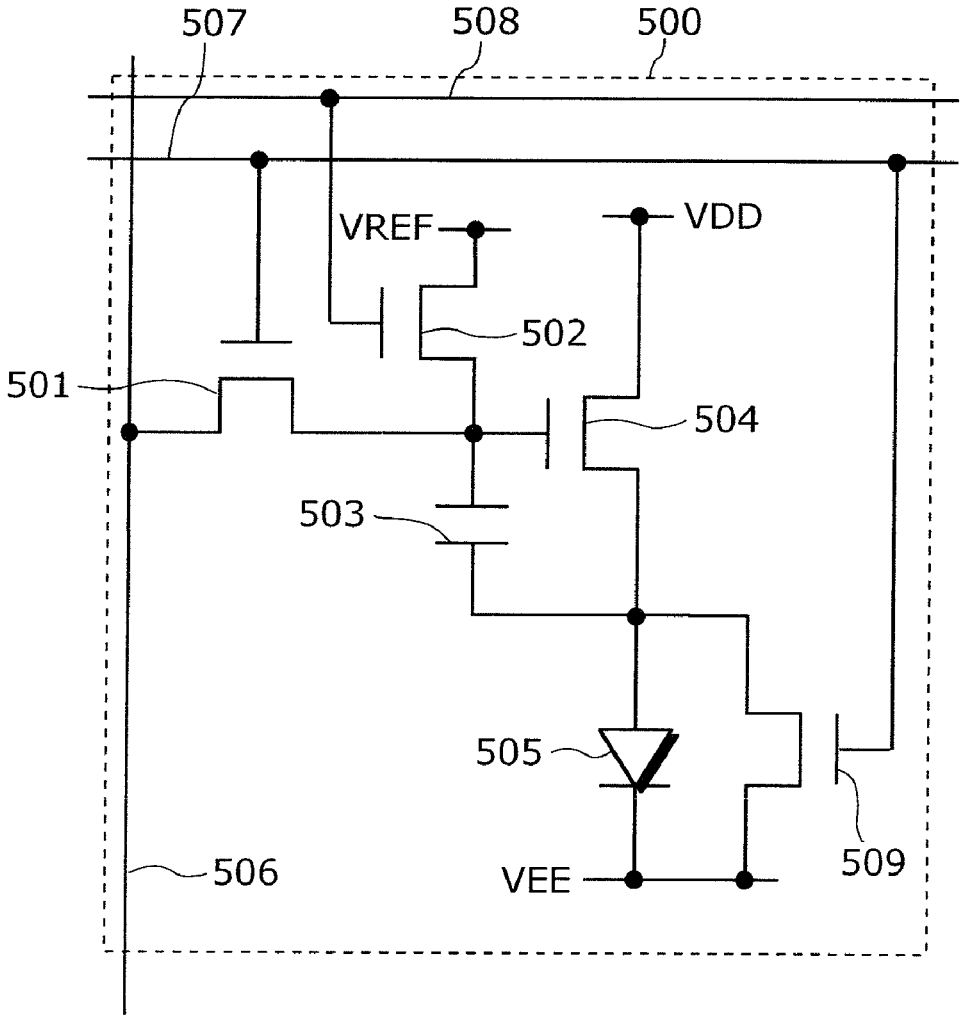
FIG. 17 is a circuit configuration diagram of a pixel unit included in a conventional organic EL display device described in Patent Reference 1.

FIG. 15 is a diagram showing a circuit configuration of a luminescence pixel included in a display unit according to Embodiment 4 of the present invention, and connection between the luminescence pixel and peripheral circuitry thereof. A luminescence pixel 10 in the figure includes a selection transistor 11, switching transistors 12 and 26, a capacitor element 13, a driving transistor 24, an organic EL element 25, a first scanning line 17; a second scanning line 18, a third scanning line 19, a data line 20, a first power line 31, a second power line 32, and a reference power line 23. In addition, the peripheral circuitry includes a scanning line driving circuit 4 and a data line driving circuit 5.

In comparison with the display device according to Embodiment 2, the display device according to the present embodiment differs only in a circuit configuration of a luminescence pixel. In other words, a driving transistor is a p-type transistor having a source connected to a cathode of an organic EL element. Hereinafter, descriptions of similarities to the display device according to Embodiment 2 are omitted, and only differences from the display device according to Embodiment 2 are described.

The driving transistor 24 is a driving element having a gate connected to an electrode 131 of the capacitor element 13, a drain connected to the first power line 31, and a source connected to one of a source and a drain of a switching transistor 26. The driving transistor 24 transforms a voltage corresponding to a data voltage applied to between the gate and the other one of the source and the drain of the switching transistor 26 into a drain current corresponding to the data voltage. Then, the driving transistor 24 supplies the drain current as a signal current to the organic EL element 25. For example, when the selection transistor 11 and the switching transistor 12 are in an off-state and the switching transistor 26 is in an on-state, the driving transistor 24 functions to supply to the organic EL element 25 a voltage corresponding to a data voltage Vdata supplied from the data line 20, that is, a drain current corresponding to a voltage (VR−Vdata) held by the capacitor element 13. The driving transistor 24 is configured by, for instance, a p-type thin-film transistor (p-type TFT).

The organic EL element 25 is a luminescence element having a cathode connected to one of the source and the drain of the switching transistor 26 and an anode connected to the second power line 32. A flow of the drain current of the driving transistor 24 into the organic EL element 25 causes the organic EL element 25 to produce luminescence.

The switching transistor 26 is a third switching element having a gate connected to the third scanning line 19, one of a source and a drain connected to the source of the driving transistor 24, and the other one connected to the cathode of the organic EL element 25. The switching transistor 26 is provided between the cathode of the organic EL element 25 and the first power line 31, connected in series with the driving transistor 24, and functions to determine turning on or off of the drain current of the driving transistor 24. The switching transistor 26 is configured by, for example, an n-type thin-film transistor (n-type TFT).

The above circuit configuration makes it possible to cause the capacitor element 13 to hold a voltage having a desired difference in potential after the switching transistor 26 interrupts a current flowing between the first power line 31 and the data line 20 via the source of the driving transistor 24 and the selection transistor 11. This prevents the difference in potential between the both terminals of the selection transistor 11 from varying depending on the current flowing between the first power line 31 and the data line 20 via the source of the driving transistor 24 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. Consequently, the difference in potential between the both electrodes of the capacitor element 13, that is, the difference in potential between the gate and the source of the driving transistor 24 is stabilized, and the drain current corresponding to the voltage having the desired difference in potential can be accurately passed to the organic EL element 25.

The control method of the display device according to the present embodiment is same as that of the display device according to Embodiment 2, and produces the same advantageous effects as those of the display device according to Embodiment 2.

However, in the test mode, a difference in potential between a second power supply voltage VEE and the maximum value of a data voltage Vdata is less than a threshold voltage of the organic EL element 25 (hereinafter referred to as Vth(EL)).

In addition, each of power supply voltages is set in the test mode so that second power supply voltage VEE-first power supply voltage VDD<Vth(EL) is made possible. Accordingly, the drain current of the driving transistor 24 does not flow into the organic EL element 25, but flows into the data line 20 via the source of the driving transistor 24 and an electrode 132 of the capacitor element 13.

Furthermore, at the time of the drain current reading in the test mode, a current Ipix flows from the data line 20 to the first power line 31 via the selection transistor 11 and the source of the driving transistor 24.

Moreover, in the normal luminescence mode, a difference in potential between the second power supply voltage VEE and the minimum value of the data voltage Vdata (Vdata min) is less than the Vth(EL) of the organic EL element 25.

Furthermore, each of the power supply voltages is set in the normal luminescence mode so that the second power supply voltage VEE-the first power supply voltage VDD>Vth(EL) is made possible. Accordingly, the drain current of the driving transistor 24 which corresponds to the voltage held in the both electrodes of the capacitor element 13 flows into the organic EL element 25.

The above circuit configuration makes it possible to cause the capacitor element 13 to hold the voltage having the desired difference in potential after the switching transistor 26 interrupts a current flowing between the first power line 31 and the data line 20 via the source of the driving transistor 24 and the selection transistor 11. This prevents the difference in potential between the both terminals of the selection transistor 11 from varying depending on the current flowing between the first power line 31 and the data line 20 via the source of the driving transistor 24 and the selection transistor 11. Accordingly, the difference in potential between the both terminals of the selection transistor 11 is stabilized, and the voltage corresponding to the voltage having the desired difference in potential can be accurately held by the capacitor element 13 from the data line 20 via the selection transistor 11. As a result, this circuit operation becomes identical to a source grounding circuit operation in which the difference in potential between the gate and the source of the driving transistor 24 is not easily influenced by a voltage variation of the second power line 32 and a source potential variation of the driving transistor 24 that is caused by an increase in resistance with time degradation of the organic EL element 25, and the drain current corresponding to the voltage having the desired difference in potential can be accurately passed to the organic EL element 25.

As mentioned above, configuring the simple pixel circuit described in Embodiments 1 to 4 makes it possible to cause the both terminals of the capacitor element to record the accurate potential corresponding to the data voltage, the capacitor element holding the voltage to be applied to between the gate and the source of the driving transistor which performs the source grounding operation. As a result, the highly accurate image reflecting the video signals can be displayed. Further, when the amount of the current supplied to the organic EL element via the power line is read and measured via the data line, the amount of the current supplied to the organic EL element via the power line can be accurately measured.

It is to be noted that the display device of the present invention is not limited to the above-mentioned embodiments. The present invention includes other embodiments realized by combining any of the constitutional elements described in Embodiments 1 to 4 and modifications thereof, modifications that those skilled in the art can obtain by performing conceivable various modifications on Embodiments 1 to 4 and the modifications without materially departing from the scope of the present invention, and various types of apparatuses including the display device of the present invention.

It is to be noted that although it has been described in the above-mentioned embodiments that the n-type transistor is in an on-state when the voltage level of the gate of the selection transistor and the switching transistor, even an image display device in which the p-type transistor includes the selection transistor and the switching transistor and polarities of scanning lines are reversed can produce the same advantageous effects as those in each of the above-mentioned embodiments.

In addition, for instance, the display device of the present invention is included in a flat-screen TV. A flat-screen TV capable of displaying a highly accurate image reflecting video signals is realized by including the image display device of the present invention therein.

INDUSTRIAL APPLICABILITY

The present invention is especially useful for active organic EL flat panel displays which vary luminance by controlling luminescence intensity of pixels using pixel signal currents.

What is claimed is:

1. A display panel device, comprising:

a luminescence element;

a capacitor for holding a voltage;

a driver including a gate electrode connected to a first electrode of the capacitor for driving the luminescence element to produce luminescence by passing, into the luminescence element, a drain current corresponding to the voltage held by the capacitor;

a first power line for determining a potential of a drain electrode of the driver;

a second power line connected to a second electrode of the luminescence element;

a first switch connected to the first electrode of the capacitor for setting a reference voltage to the first electrode of the capacitor;

a data line for supplying a data voltage to a second electrode of the capacitor;

a second switch connected to the data line and the second electrode of the capacitor for switching between a conduction state and a non-conduction state between the data line and the second electrode of the capacitor;

a wiring connected to the first electrode of the luminescence element and the second electrode of the capacitor for interconnecting the first power line and the first electrode of the luminescence element with the second electrode of the capacitor, the second switch, and the data line; and a third switch connected in series with the driver between the first electrode of the luminescence element and the first power line for determining an ON state and an OFF state of the drain current of the driver.

2. The display panel device according to claim 1, further comprising:

a controller configured to control the first switch, the second switch, and the third switch, wherein the controller is configured to:

turn OFF the third switch for interrupting a flow of the drain current between the first power line and the data line via the wiring and the second switch;

turn ON the first switch and the second switch for setting the reference voltage to the first electrode of the capacitor and for setting the data voltage to the second electrode of the capacitor for causing the capacitor to hold the voltage having a predetermined potential difference; and turn ON the third switch while the first switch and the second switch are OFF for causing the drain current corresponding to the voltage having the predetermined potential difference to flow into the luminescence element.

3. The display panel device according to claim 2, wherein the controller is further configured to turn OFF the third switch to interrupt the flow of the drain current between the first power line and the data line via the wiring and the second switch and to interrupt a flow of a current between the first power line and the second power line.

4. The display panel device according to claim 1, wherein the third switch is between the first power line and the drain electrode of the driver, and a source electrode of the driver is connected to the first electrode of the luminescence element.

5. The display panel device according to claim 1, wherein the third switch is between the first electrode of the luminescence element and a source of the driver, and the drain electrode of the driver is connected to the first power line.

6. The display panel device according to claim 2, wherein the first electrode of the luminescence element is an anode, the second electrode of the luminescence element is a cathode, a voltage of the first power line is greater than a voltage of the second power line, and a current flows from the first power line to the second power line.

7. The display panel device according to claim 4, wherein the controller is configured to:

turn OFF the third switch to interrupt a flow of a current from the first power line to the luminescence element turn ON the first switch and the second switch to set the reference voltage to the first electrode of the capacitor and to set the data voltage to the second electrode of the capacitor for causing the capacitor to hold the voltage having a predetermined potential difference; and turn OFF the first switch and turn ON the second switch and the third switch to pass, into the data line, the drain current corresponding to the voltage having the predetermined potential difference via the wiring and the second switch.

8. The display panel device according to claim 5, comprising:

a setter configured to set, to the second power line, one of a first voltage and a second voltage, the first voltage being greater than a voltage obtained by subtracting a luminescence start voltage of the luminescence element from a preset voltage of a power supply connected to the first power line, the second voltage being less than the first voltage, wherein the data voltage is a voltage less than the first voltage, and a controller is configured to:

set the second voltage to the second power line and turn OFF the second switch to pass the drain current from the first power line into the luminescence element when the luminescence element is caused to produce luminescence; and set the first voltage to the second power line and turn ON the second switch to pass the drain current from the first power line into the data line when the drain current is measured.

9. The display panel device according to claim 2, wherein the first electrode of the luminescence element is a cathode, the second electrode of the luminescence element is an anode, a voltage of the second power line is greater than a voltage of the first power line, and a current flows from the second power line to the first power line.

10. The display panel device according to claim 9, wherein the controller is configured to:

turn OFF the third switch to interrupt a flow of a current from the first power line to the luminescence element;

turn ON the first switch and the second switch to set the reference voltage to the first electrode of the capacitor and to set the data voltage to the second electrode of the capacitor for causing the capacitor to hold the voltage having a predetermined potential difference; and turn OFF the first switch and turn ON the second switch and the third switch to pass, from the data line, the drain current corresponding to the voltage having the predetermined potential difference via the wiring and the second switch.

11. The display panel device according to claim 10, comprising:

a setter configured to set, to the second power line, one of a third voltage and a fourth voltage, the third voltage being less than a voltage obtained by adding a luminescence start voltage of the luminescence element to a preset voltage of a power supply connected to the first power line, the fourth voltage being greater than the third voltage, wherein the data voltage is a voltage greater than the third voltage, and the controller is configured to:

set the fourth voltage to the second power line and turn OFF the second switch to pass a current from the luminescence element into the first power line when the luminescence element is caused to produce luminescence; and set the third voltage to the second power line and turn ON the second switch to pass the drain current from the data line into the first power line when the drain current is measured.

12. A display device, comprising:

display panel device according to claim 1; and a power source which supplies power to the first power line and the second power line, wherein the luminescence element includes the first electrode, the second electrode, and a luminescence layer sandwiched between the first electrode and the second electrode, and a plurality of the luminescence element is arranged in a matrix.

13. A display device, comprising:

display panel device according to claim 1; and a power source which supplies power to the first power line and the second power line, wherein the luminescence element includes the first electrode, the second electrode, and a luminescence layer sandwiched between the first electrode and the second electrode, a pixel circuit includes at least the luminescence element and the third switch, and a plurality of the pixel circuit is arranged in a matrix.

14. A display device, comprising:

display panel device according to claim 1; and a power source which supplies power to the first power line and the second power line, wherein the luminescence element includes the first electrode, the second electrode, and a luminescence layer sandwiched between the first electrode and the second electrode, a pixel circuit includes the luminescence element, the capacitor, the driver, the first switch, the second switch, and the third switch, and a plurality of the pixel circuit is arranged in a matrix.

15. The display device according to claim 12, wherein the luminescence element is an organic electroluminescence element.

16. A control method for a display device, wherein the display device includes:

a luminescence element;

a capacitor for holding a voltage;

a driver including a gate electrode connected to a first electrode of the capacitor for driving the luminescence element to produce luminescence by passing, into the luminescence element, a drain current corresponding to the voltage held by the capacitor;

a first power line for determining a potential of a drain electrode of the driver;

a second power line connected to a second electrode of the luminescence element;

a first switch connected to the first electrode of the capacitor for setting a reference voltage to the first electrode of the capacitor;

a data line for supplying a data voltage to a second electrode of the capacitor;

a second switch connected to the data line and the second electrode of the capacitor for switching between a conduction state and a non-conduction state between the data line and the second electrode of the capacitor;

a wiring connected to the first electrode of the luminescence element and the second electrode of the capacitor for interconnecting the first power line and the first electrode of the luminescence element with the second electrode of the capacitor, the second switch, and the data line; and a third switch connected in series with the driver between the first electrode of the luminescence element and the first power line for determining an ON state and an OFF state of the drain current of the driver, and the control method comprises:

turning OFF the third switch to interrupt a flow of the drain current between the first power line and the data line via the wiring and the second switch;

turning ON the first switch and the second switch to set the reference voltage to the first electrode of the capacitor and to set the data voltage to the second electrode of the capacitor for causing the capacitor to hold the voltage having a predetermined potential difference while the flow of the drain current is being interrupted; and turning OFF the first switch and the second switch and turning ON the third switch to pass, into the luminescence element, the drain current corresponding to the voltage having the predetermined potential difference after the voltage having the desired potential difference is caused to be held.

* * * * *